US006682258B2

(12) United States Patent
McNeely

(10) Patent No.: US 6,682,258 B2
(45) Date of Patent: Jan. 27, 2004

(54) NONDESTRUCTIVE SYSTEM FOR ADJUSTING MANHOLE AND CATCH-BASIN ELEVATIONS

(75) Inventor: P. Dennis McNeely, Ann Arbor, MI (US)

(73) Assignee: Anchor Tool & Die Company, Cleveland, OH (US)

( * ) Notice: Subject to any disclaimer, the term of this patent is extended or adjusted under 35 U.S.C. 154(b) by 0 days.

(21) Appl. No.: 10/223,131

(22) Filed: Aug. 19, 2002

(65) Prior Publication Data

US 2002/0192023 A1 Dec. 19, 2002

Related U.S. Application Data

(63) Continuation of application No. 09/663,577, filed on Sep. 15, 2000, now Pat. No. 6,435,764.

(60) Provisional application No. 60/154,057, filed on Sep. 16, 1999, and provisional application No. 60/157,811, filed on Oct. 4, 1999.

(51) Int. Cl.[7] ..... E02D 29/14

(52) U.S. Cl. ..... 404/26; 52/20

(58) Field of Search ..... 404/25, 26; 52/19, 52/20, 21

(56) References Cited

U.S. PATENT DOCUMENTS

| | | | | |
|---|---|---|---|---|
| 4,149,816 A | | 4/1979 | Piso | |
| 4,906,128 A | | 3/1990 | Trudel | |
| 4,925,337 A | | 5/1990 | Spiess et al. | |
| 5,095,667 A | | 3/1992 | Ryan et al. | |
| 5,211,504 A | | 5/1993 | Trudel | |
| 5,308,189 A | | 5/1994 | Claing | |
| 5,318,376 A | | 6/1994 | Prescott, Sr. | |
| 5,344,253 A | | 9/1994 | Sacchetti | |
| 5,360,131 A | | 11/1994 | Phillipps et al. | |
| 5,451,119 A | | 9/1995 | Hondulas | |
| 5,470,172 A | | 11/1995 | Wiedrich | |
| 5,564,855 A | | 10/1996 | Anderson | |
| 5,769,564 A | | 6/1998 | Hawkins | |
| 5,800,143 A | * | 9/1998 | Bravo | 405/52 |
| 5,813,797 A | * | 9/1998 | Pendleton et al. | 405/52 |
| 5,899,024 A | | 5/1999 | Stannard | |
| 5,934,820 A | | 8/1999 | Hinkle | |
| 6,350,081 B1 | * | 2/2002 | Khajavi et al. | 404/25 |

* cited by examiner

*Primary Examiner*—Thomas B. Will
*Assistant Examiner*—Alexandra K. Pechhold
(74) *Attorney, Agent, or Firm*—Roetzel & Andress

(57) ABSTRACT

An assembly for adjusting the elevation of a structure such as a manhole or a catch basin to be surrounded by pavement. A one-piece is formed to be inserted between a base rim and a cover of the structure. A lower member of the adapter is received in the base rim to be supported on an internal shoulder. An upper member extends outwardly of the lower member to receive the cover and upwardly to engage the upper end of the base rim and form an upward extension of the rim. The elevation of the structure may be increased by inserting the adapter between the base rim shoulder and the cover and decreased by removing the adapter from between the base rim shoulder and the cover. Additional adapters of identical construction may be inserted to further increase the elevation of the structure, all the adapters being nestable within one another.

21 Claims, 20 Drawing Sheets

NONDESTRUCTIVE SYSTEM FOR ADJUSTING MANHOLE AND CATCH-BASIN ELEVATIONS

RELATED APPLICATIONS

This application claims the benefit of Provisional Patent Application Ser. No. 60/154,057, filed Sep. 16, 1999 and Provisional Patent Application Ser. No. 60/157,811, filed Oct. 4, 1999, and is a continuation of Ser. No. 09/663,577 filed Sep. 15, 2000, now U.S. Pat. No. 6,435,764.

BACKGROUND OF THE INVENTION

1. Field of the Invention

This invention relates to a method of and means for raising both the base rim and the cover of a manhole, catch basin or other cast structure surrounded by pavement. The geometry of the rim and cover permit the use of a one-piece adapter which is itself cast entirely of the same material as the rim and cover. Further, the adapter allows the rim and cover elevation to be quickly raised by an amount less than the thickness of the cover, without requiring the removal of the surrounding pavement.

2. The Prior Art

Castings in newly paved areas ordinarily have rim elevations equal to the finished elevation of the pavement adjacent to the structure. If the pavement includes a bituminous section, the final lift of pavement (the wearing course) may not be installed for a year or more. During this time, castings which are in the bituminous pavement are left high to accommodate the ultimate placement of the wearing course. Such castings constitute an obstacle to pedestrian and vehicular traffic. Further, the lip created by the raised casting obstructs street scraping and cleaning operations as well as snow plowing, and impedes storm water drainage if the structure is part of the storm system.

One method of renovating the surface of a road is to place a bituminous overlay over the existing paving. Unless the overlay is thicker than the respective covers of structures within the overlay, the existing pavement must be removed from around the structure to allow the rim and cover elevation to be raised with shims. The adjusted structure elevation will then accommodate the placement of the overlay. Pavement that was removed to facilitate placement of the shims is replaced prior to placement of the overlay, which then serves as a new wearing course. This process is both time-consuming and costly, and causes additional congestion and potential for liability for workers renovating the road and for drivers frequenting the road.

An alternate method of renovating the surface of a road consists of removing the top layer of the road's surface and replacing the top layer with a new bituminous wearing course. The removal of the top layer of paving can be accomplished by milling the road's surface, but paving immediately adjacent to the structure requires hand work to remove. This process also involves extra time, additional expense; and increases traffic congestion and potential for liability.

In an effort to diminish such traffic congestion and potential for liability, and at the same time to reduce paving budgets, some municipalities have begun to use adapters which incorporate relatively thin steel segments. Alternately, the municipality or developer simply directs the paver to taper the overlay to meet the rim of the structure at its original grade.

The thin steel segments allow a method of quickly raising rim elevations a minimal amount, but introduce possible problems with regard to structural strength, access, and corrosion resistance.

The structural strength of the new adapters which incorporate thin steel segments is suspect, given the pounding the structure is subject to while the asphalt overlay is being placed, and impacting by snow plows and vehicle traffic. The adapter may not fail entirely, but may warp sufficiently to make removal and replacement of the cover problematic. Many such adapters require the use of protruding setscrews to secure the adapter to the rim below. The setscrews reduce the effective open area of the casting, and can be the cause of injury or damage to personnel or equipment entering or exiting the manhole.

Similarly, introducing a dissimilar metal such as steel between the rim and the cover is an invitation to galvanic corrosion, particularly in those areas which use rock salt or a similar material to treat snow and ice buildup on road surfaces.

Numerous solutions have been proposed in an effort to facilitate the adjustment of the rim elevation, as follows:

Pavement is removed adjacent to the structure, and shims are inserted under the casting to bring it to the proposed elevation of the wearing course. This method is commonly practiced on construction sites now, and further refinements are disclosed in patents such as U.S. Pat. No. 5,934,820 to Vernon W. Hinkle, U.S. Pat. No. 5,564,855 to Dennis C. Anderson, and U.S. Pat. No. 5,470,172 to Dwight G. Wiedrich.

Manipulation of the casting within the pavement, a method which purports to allow vertical adjustment of the rim elevation without disturbing the surrounding pavement, frequently fails in the field, possibly resulting in delays in paving the surrounding area. This technique is taught in U.S. Pat. No. 5,451,119 to John L. Hondulas, U.S. Pat. No. 5,318,376 to Everett J. Prescott, Sr., and U.S. Pat. No. 5,095,667 to Chester Ryan.

The casting is raised by manipulation of threaded bolts, as shown in U.S. Pat. No. 5,344,253 to Cesare Sacchetti. U.S. Pat. No. 4,925,337 to Hansruedi Spiess and Francoix Galvanetto, and U.S. Pat. No. 4,149,816 to Johannes L. Piso. These designs subject the casting to extreme point loading at each of the adjustment bolts, and create an opportunity for both mechanical failure and/or corrosion at each such bolt. Similarly, designs have been proposed which allow convenient adjustment of the elevation of the rim by the incorporation of steps in castings which mate in making up the rim as a whole. U.S. Pat. No. 5,360,131 to Guy M Phillipps and Wayne A Harris, U.S. Pat. No. 5,211,504 to Roger Trudel, and U.S. Pat. No. 4,906,128 to Roger Trudel all propose variations of steps in adjoining castings; and all impose point loading at the step locations in a manner similar to the point loading caused by the adjustment bolts as indicated above.

The cover elevation is raised by the insertion of a cylindrical shim under the cover. Here, a cylindrical section is added outside the perimeter of the cover to raise the elevation of the rim. Prior-art teachings frequently show the shim for the rim to be made of an insubstantial material, either disassociated from the cover shim entirely or connected with a thin strip of metal to facilitate the re-use of the original cover. U.S. Pat. No. 5,899,024 to Edward C. Stannard, U.S. Pat. No. 5,769,564 to David John Drake Hawkins, and U.S. Pat. No. 5,308,189 to Jean-Louis Claing all teach the use of such designs. The rim shim is prone to damage or destruction by vehicular traffic, snow plows etc., due to its light section and marginal connection-to the underlying cover shim. In many instances, the construction of the shim assembly results in the mating of dissimilar metals and subsequently suffers the accelerated corrosion attendant upon such mating.

Numerous other methods have been advocated to facilitate the adjustment of structure elevations within pavement areas; none have achieved widespread acceptance for a variety of reasons, some of which are mentioned above. The ideal solution would permit the structure to remain flush with the surrounding pavement for an indeterminate period, and would permit the rapid adjustment of the elevation of both the rim and the cover immediately prior to milling or paving, without causing excessive delays to traffic and unnecessary expenses to the developer or municipality. Perhaps most importantly, the danger to motorists dodging traffic barricades and to workers protected by the barricades will be minimized, as casting elevations can be adjusted in minutes rather than days.

SUMMARY OF THE INVENTION

The invention provides an assembly for adjusting the elevation of a structure such as a manhole or a catch basin having a base rim surrounded by pavement, the base rim comprising an outer wall and a support shoulder extending inwardly from the wall and spaced downwardly from an upper end thereof. The assembly comprises a cover, and an adapter formed in a single piece to support the cover thereon and having upper and lower members. The lower member is receivable within the wall of the base rim to be supported on the shoulder thereof, the upper member extending outwardly of the lower member to receive the cover therewithin and upwardly to engage the upper end of the base rim and form an upward extension thereof. The lower member is formed with a plurality of inwardly extending protrusions distributed to form spaces therebetween and interconnecting the upper and lower members to form steps at the protrusions. The cover is receivable within the upper member to be supported on the lower member. the cover being formed with a plurality of indentations in a lower surface thereof, the indentations being dimensioned and disposed to receive the adapter protrusions therewithin. Portions of the cover above the indentations are dimensioned and disposed to be supported on the steps. With this construction, the elevation of the structure may be increased by supporting the assembly on the base rim of the structure and decreased by removing the adapter from between the base rim shoulder and the cover.

The vertical dimensions of the adapter may be calculated to raise the elevation of the structure through a distance smaller than the thickness of the cover when the adapter is inserted between the base rim and the cover.

The assembly may include one or more additional adapters of identical construction with the first, all the adapters being formed to nest within one another, the elevation of the structure thus being dependent upon the number of adapters inserted between the base rim and the cover.

Where the structure is a manhole, the base rim, the adapter and the cover are of generally cylindrical form.

On the other hand, where the structure is a catch basin, the base rim, the adapter and the cover are of generally rectangular form.

As described above, the assembly may be applied to an existing structure in which the base rim is of conventional configuration. However, for new installations, a base rim may be provided in accordance with the invention in which the base rim shoulder is formed with a plurality of upwardly extending protrusions dimensioned and disposed to be received in the spaces formed by the adapter protrusions in alternating relation with them.

Use of the invention allows pavement to be installed in new road sections without the necessity of leaving structures protruding from the initial lift or lifts pending installation of the final wearing course, which may not occur for a year or more The invention facilitates adjustment of the rim elevation of structures in paved areas which are to receive an overlay, without requiring the removal of pavement around the structure The invention also facilitates removal of the top layer of pavement adjacent to structures in paved areas by milling rather than requiring handwork.

The invention provides complete drainage around storm structures in the above circumstances, including those structures which may be located partially in a concrete curb and gutter and partially in a bituminous paving section The invention allows rim elevation adjustment to be accomplished quickly and accurately minutes before the wearing course or overlay is placed In short, the unique geometry of rims, covers, and adapters according to the invention permits the rapid adjustment of the elevation of manholes, catch basins, and other structures within paved areas. Such elevation adjustment can be accomplished without having to remove pavement or curb and gutter. Further, the unique geometry allows the adjustment to be carried out in minutes, just before the placement of new paving adjacent to the structure.

This ability reduces the danger to highway construction crews and motorists, reduces necessary finding for paving projects, and reduces traffic congestion caused by road repairs.

These and other features and advantages of the invention will be apparent from the ensuing description in conjunction with the accompanying drawings.

DESCRIPTION OF THE PREFERRED EMBODIMENTS

Figure 1:
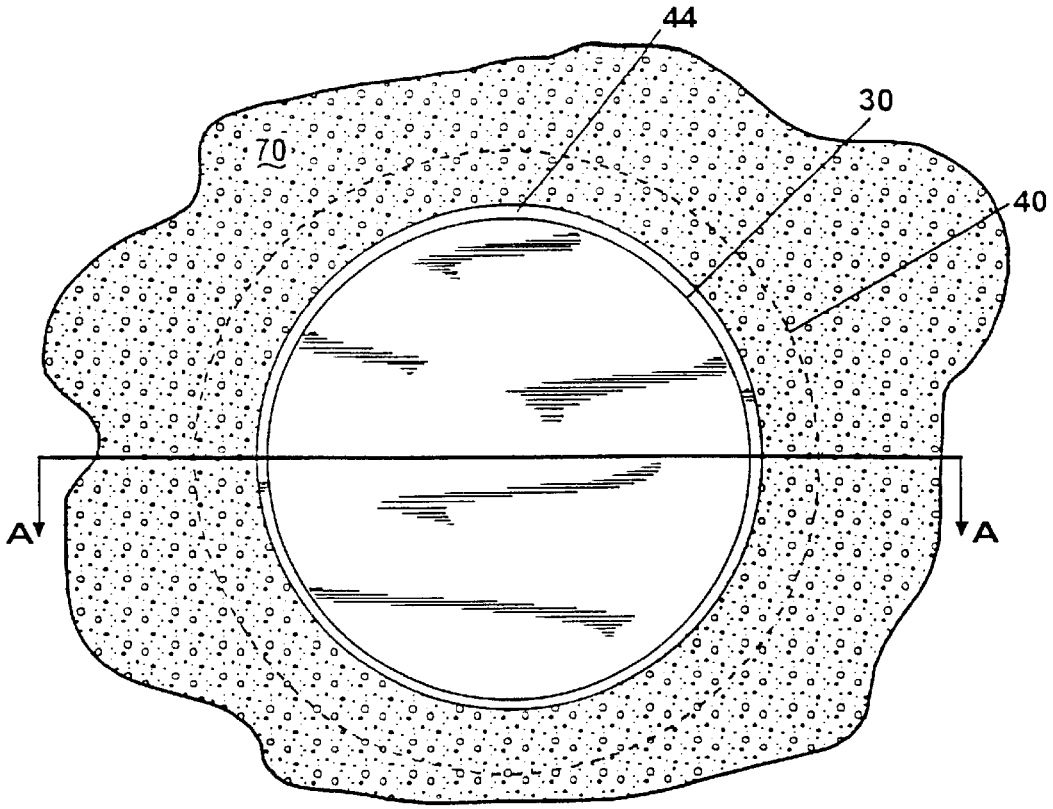
Fig. 1 (PRIOR ART)
FIG. 1 is a plan view of a typical prior-art manhole cover assembly.
Figure 1A:
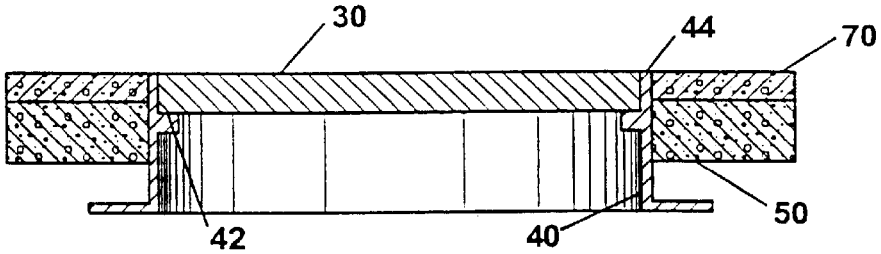
Fig. 1A (PRIOR ART)
FIG. 1A is a cross-sectional view of the prior-art assembly of FIG. 1, showing a cover supported by an internal shoulder of a rim.
Figure 2:
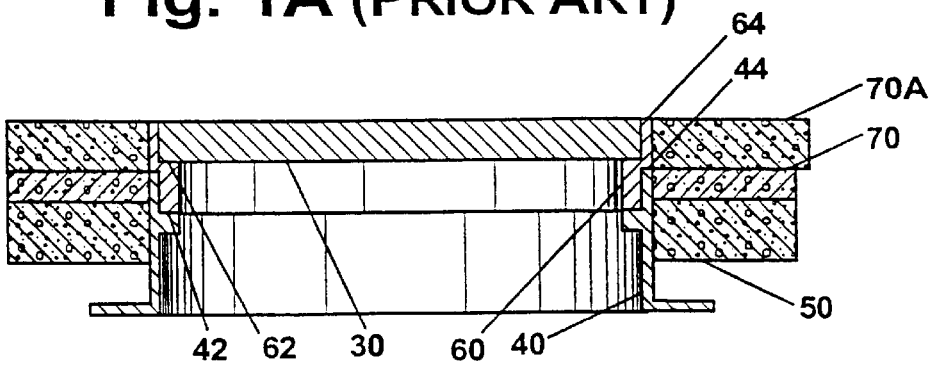
Fig. 2 (PRIOR ART)
FIG. 2 is a view similar to FIG. 2. showing the placement of a prior-art height adapter in cross section.

The prior art shown in FIG. 1 sought to provide a means of adjusting the elevation of a manhole or catch basin (or other structure) in a paved-area by using a cover 30, a rim 40, and an overlay adapter 60 (FIG. 2). The cover shown is depicted as a circular disk, and is typically fabricated of cast iron. The rim is also typically cast iron and comprises a cylindrical wall provided with an internal shoulder 42 (FIG. 1A) which supports the cover at the elevation of the pavement adjacent to the rim. The rim shown in FIG. 1 is cylindrical, and fits snugly around the perimeter of the cover. The bottom of the rim is typically flared, and rests on a masonry structure (not shown) which is itself part of a larger underground infrastructure. A rim extension 44 extends upward beyond the internal shoulder, adjacent to and flush with the upper surface of the cover.

FIG. 1A shows the prior-art cover 30 and rim extension 44 above a leveling course 50 of asphalt and level with a wearing course 70 of asphalt. The overlay adapter 60 (FIG. 2) is used to support the cover at a higher elevation, and to provide an adapter extension 64 (FIG. 2) above the rim extension. The overlay adapter effectively increases the elevation of both the cover and the rim extension to allow the placement of an overlay 70A (FIG. 2) of asphalt. The overlay adapter is also typically made of cast iron, and consists of a cylindrical support 62 interposed between the internal shoulder integral to the rim and the bottom of the cover in its elevated position, as well as the adapter extension. It will be noted that the necessity of an integral structural connection between the adapter extension and the cylindrical support dictates that the thickness of the overlay be somewhat greater than the thickness of the cover.

The prior art depicted in FIGS. 1, 1A, and 2 requires that old pavement be cut from around the rim if the thickness of the overlay is less than or equal to the thickness of the cover, and that the rim be raised by inserting masonry and mortar between the rim and its masonry support. Any voids created by removal of old pavement and shimming the rim are typically filled with concrete, asphalt, or compacted granular material prior to the installation of the asphalt overlay, as an alternative to incurring the substantial expense of laying unusually thick asphalt overlays. The work preparatory to the placement of the asphalt overlay (cutting, shining, and filling) often takes longer than the placement of the asphalt overlay, and creates additional expense, traffic, congestion, and potential for liability.

Figure 19:
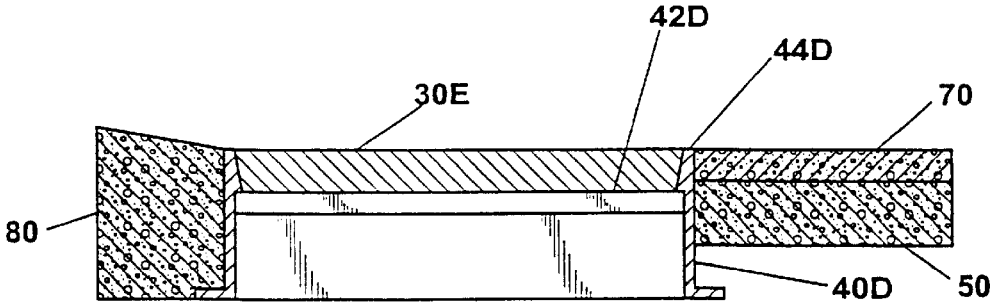
Fig. 19 (PRIOR ART)
FIG. 19 is a vertical sectional view of a typical prior-art catch basin assembly.

In addition to the prior art shown in FIGS. 1, 1A and 2, a prior-art catch basin casting is depicted in FIG. 19. It should be noted that the vertical section of the prior-art cover shown in FIG. 19 is not rectangular, as would be the case if the cover were truly cylindrical. Rather, it is trapezoidal, and represents a tapered edge where the cover meets the rim. Such a taper may be present in any of the casting designs (manhole, catch basin, etc) shown and described herein, without affecting application of the invention. The invention may be similarly applied to catch basins (both those from the prior art and those according to the invention), and to manholes (again, both those from the prior art and those according to the invention), and to various other cast structures within paved areas (handholes, etc.). The invention's application to catch basins will be examined after considering its application to manholes.

Figure 3:
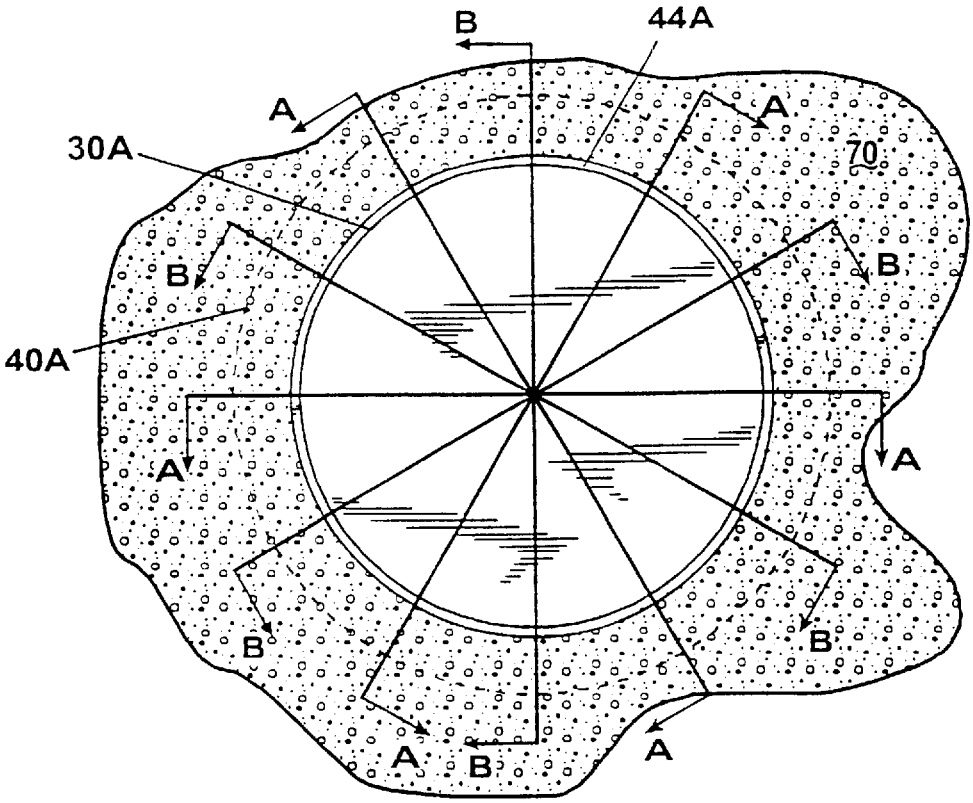
FIG. 3 is a plan view of an embodiment of a manhole cover assembly according to the invention.
Figure 3A:
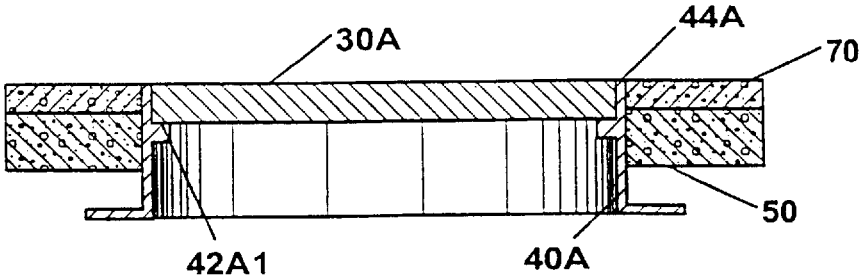
FIG. 3A is a sectional view taken along any one of lines A—A of FIG. 3.
Figure 3B:
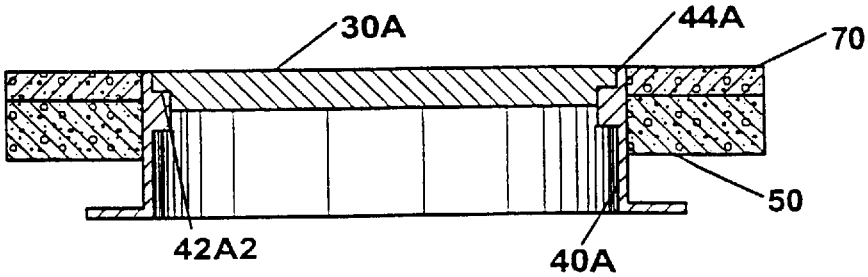
FIG. 3B is a sectional view taken along any one of lines B—B of FIG. 3.

An embodiment of a casting (such as a manhole) according to the invention, to be placed in a paved area, is shown in FIG. 3, as the casting would be initially installed. Similar to the prior art shown in FIG. 1, a rim extension 44A and a cover 30A are initially flush with the surrounding pavement. However, the cover 30A and a rim 40A have crenellated mating surfaces, as shown in FIGS. 3A, 3B, 4D and 5B. The cover varies in thickness around its perimeter, providing full structural strength at section A—A, as shown in greater detail in FIG. 3A. This section is identical in appearance with the prior-art section shown in FIG. 1A, having an internal shoulder 42A1 which supports the cover and any design load on it. The thickness of the perimeter of the cover is reduced at section B—B, as shown in greater detail in FIG. 3B. This reduced section mates with a raised step 42A2 in the internal shoulder.

Figure 4:
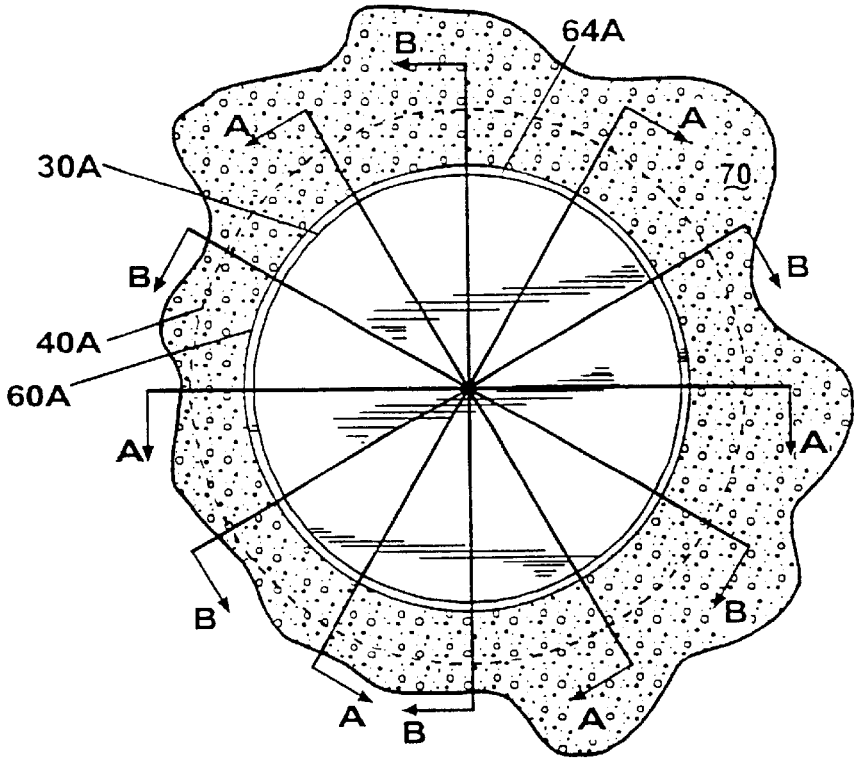
FIG. 4 is a view similar to FIG. 3.
Figure 4A:
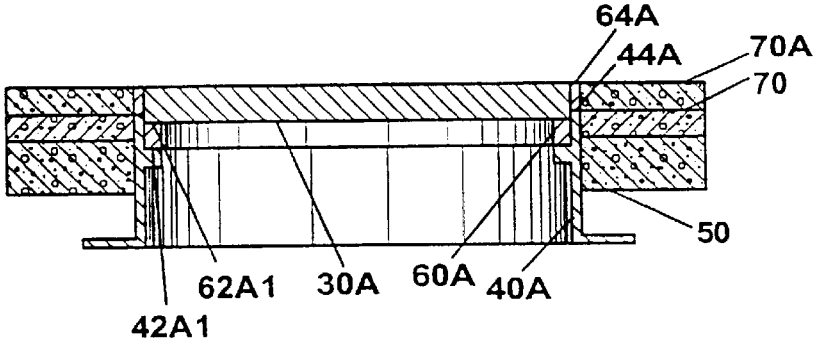
FIG. 4A is a sectional view taken along any one of lines A—A of FIG. 4 and shows an adapter according to the invention installed beneath the cover.
Figure 4B:
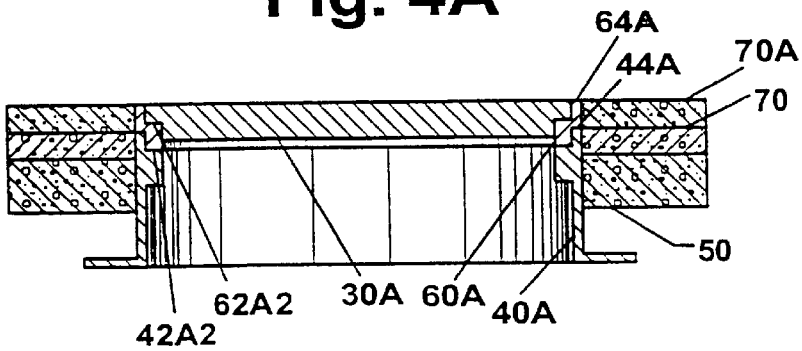
FIG. 4B is a sectional view taken along any one of lines B—B of FIG. 4.
Figure 4C:
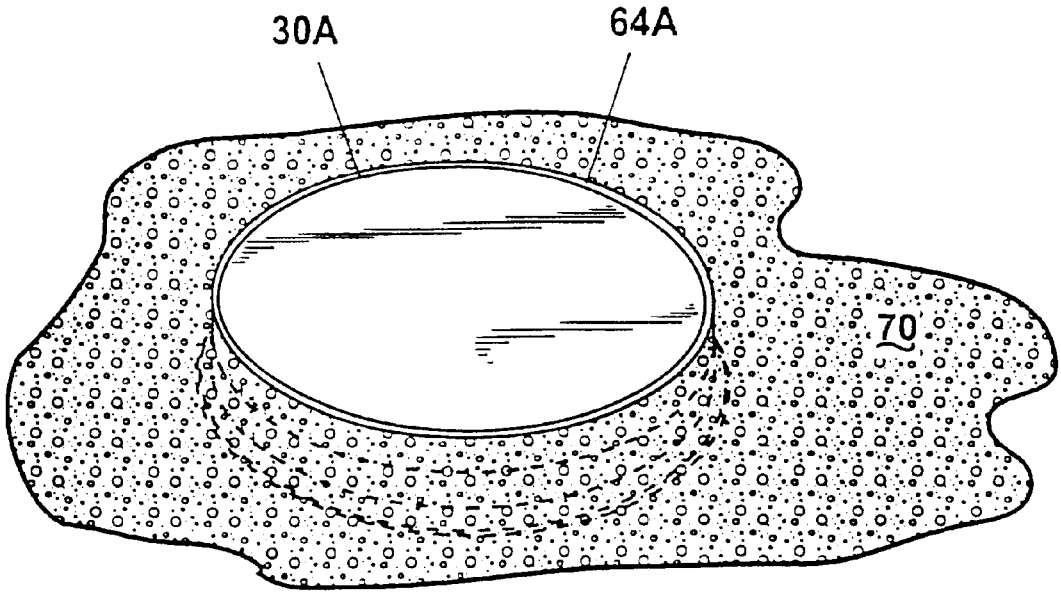
FIG. 4C is a perspective view of the assembly of FIG. 4.
Figure 4D:
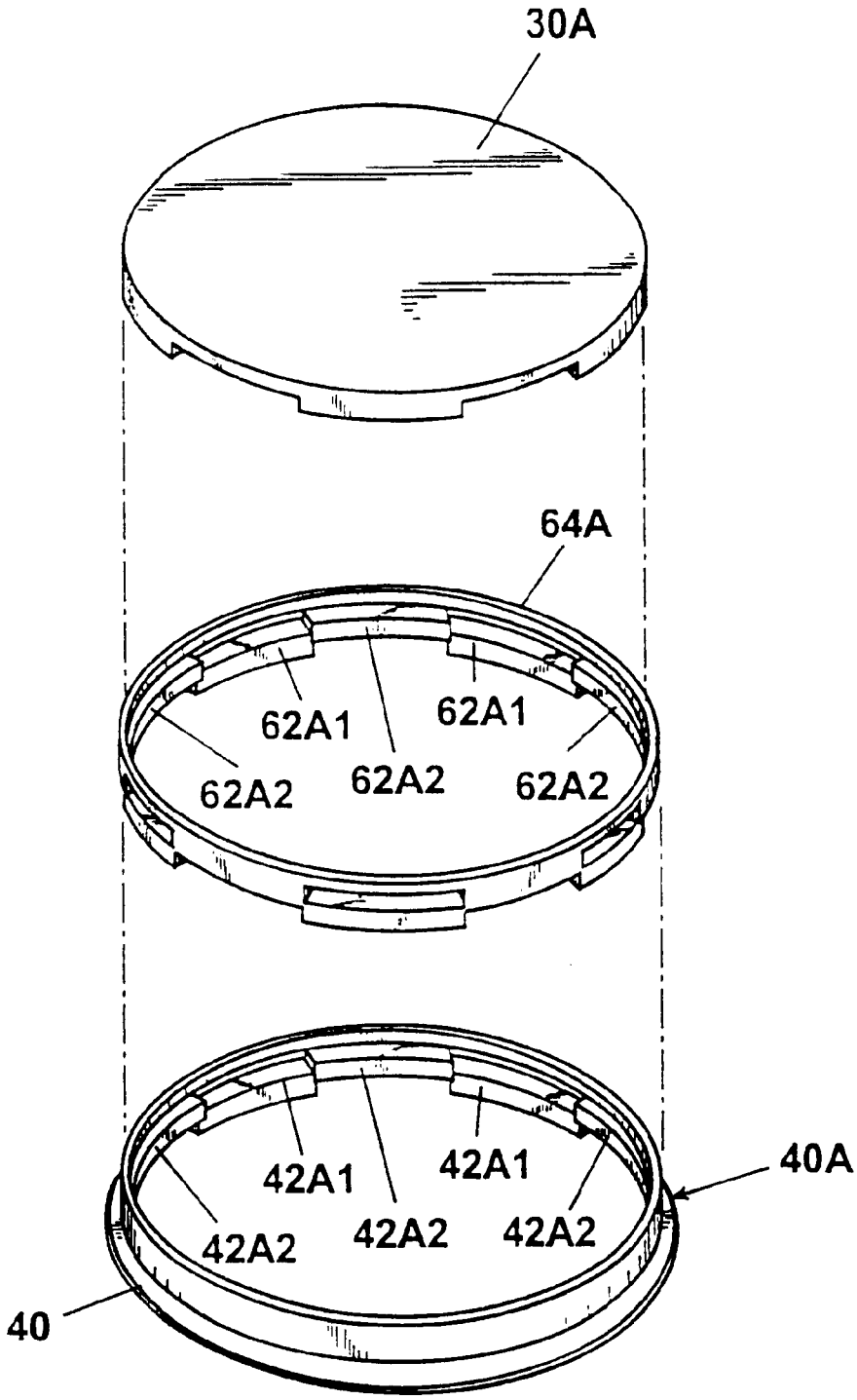
FIG. 4D is an exploded view of the assembly of FIG. 4.

The embodiment of the invention shown in FIG. 4 demonstrates the manner in which the structure in FIG. 3 can be raised in minutes, rather than requiring hours (or days) using the technique described for the prior art. A laborer merely removes the cover 30A, lays an overlay adapter 60A on rim 40A, and replaces the cover on the overlay adapter immediately prior to placement of the asphalt overlay. The overlay adapter consists of two sections, as shown in FIGS. 4A and 4B, which mate with the assembly sections shown in FIGS. 3A and 3B in the following manner.

The overlay adapter consists of two cylindrical members, the lower of which supports the cover at a new, higher elevation. This bottom cylindrical member is supported by internal shoulder 42A1 while supporting the cover on its upper surface, at support 62A1 (FIG. 4A). Similarly, FIG. 4B shows the bottom cylindrical member supported by raised step 42A2 while supporting the cover on its upper surface, a support 62A2. The second cylindrical member, an adapter extension 64A, rests on the rim extension 44A, and raises the elevation of the rim to match that of the cover. In FIG. 4A, these cylindrical members are separated. Note, however, that the cylindrical members making up the overlay adapter are structurally connected, as shown in FIG. 4B, which allows the fabrication of the overlay adapter as a single piece which can be cast entirely of the same material as the cover and rim. The overlay adapter can be secured to the rim using bolts or setscrews (not shown), or it can have a flange on its outermost diameter (not shown) to ensure that it is secured in place by the overlay. (Such methods of securing an adapter are known to one having ordinary skill in the design and fabrication of overlay adapters.)

Figure 5A:
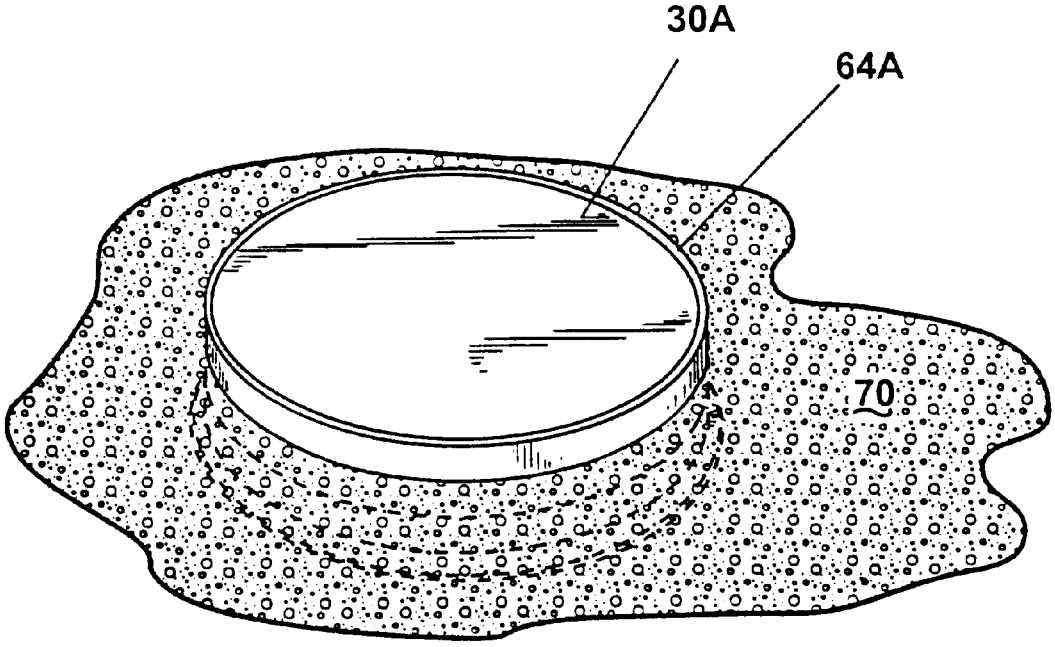
FIG. 5A is a perspective view of the assembly of FIGS. 5 and 6.
Figure 5:
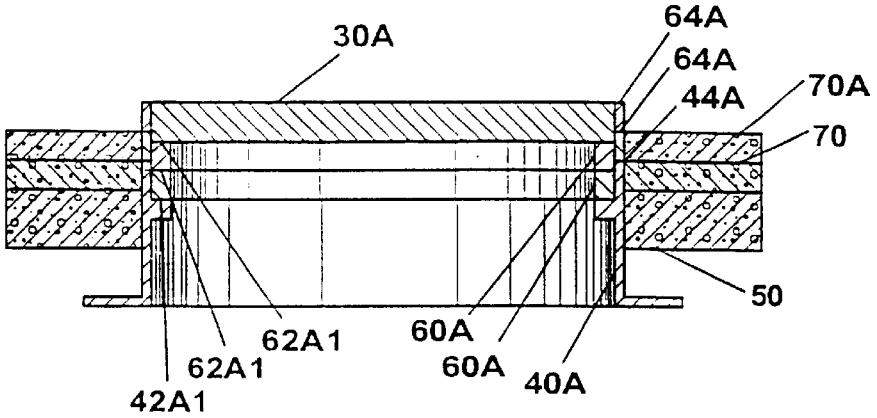
FIG. 5 is a view similar to FIG. 4A but shows an additional adapter according to the invention installed.
Figure 6:
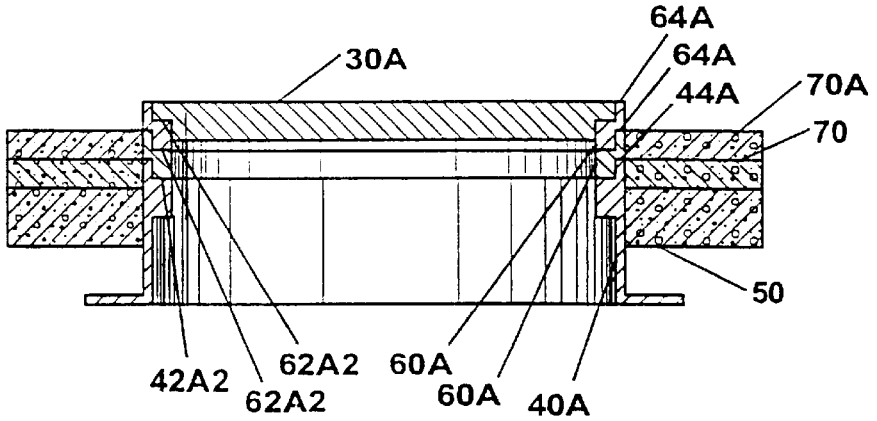
FIG. 6 is a view similar to FIG. 4B but shows the additional adapter of FIG. 5.

In accordance with the invention, the geometries of the rim, the cover, and the overlay adapter allow the placement of an overlay of asphalt of thickness less than the thickness of the cover, while allowing the use of a one-piece, all-cast overlay adapter. The thick sections of the cover (FIG. 4A) ensure that design loads are transmitted to the rim, while the thin sections of the cover (FIG. 4B) permit an adequate structural connection between the two cylindrical sections of the overlay adapter. It should be noted that the overlay adapters can be stacked to accommodate successive adjustments to the elevation of the rim and cover without reducing the clear opening of the rim, as shown in FIGS. 5 and 6, which correspond to FIGS. 4A and 4B, respectively.

Figure 7:
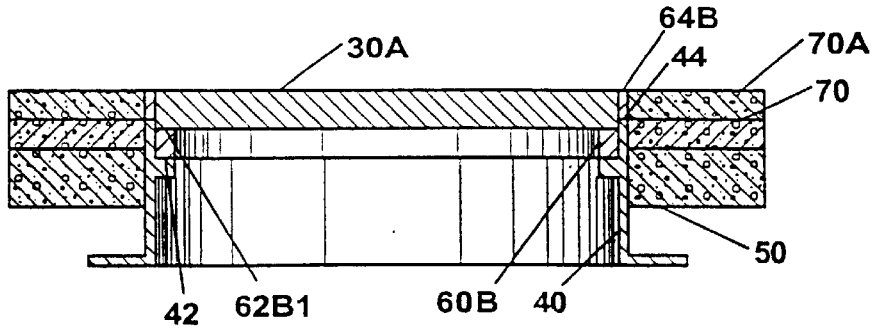
FIG. 7 is a sectional view similar to FIG. 4A but shows a second embodiment of an adapter according to the invention within a prior-art manhole rim.
Figure 8:
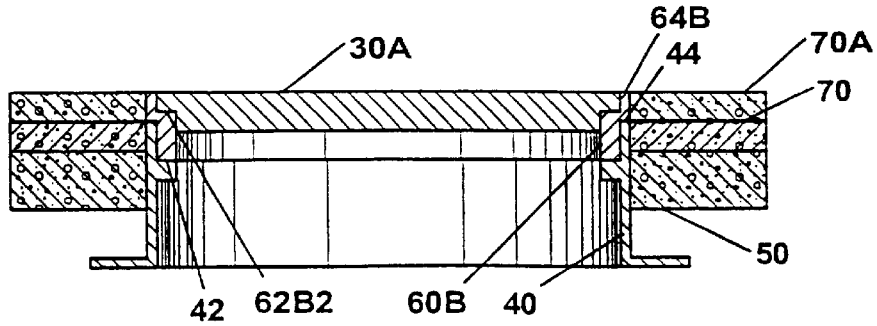
FIG. 8 is a sectional view similar to FIG. 4B but shows the adapter of FIG. 7.
Figure 5B:
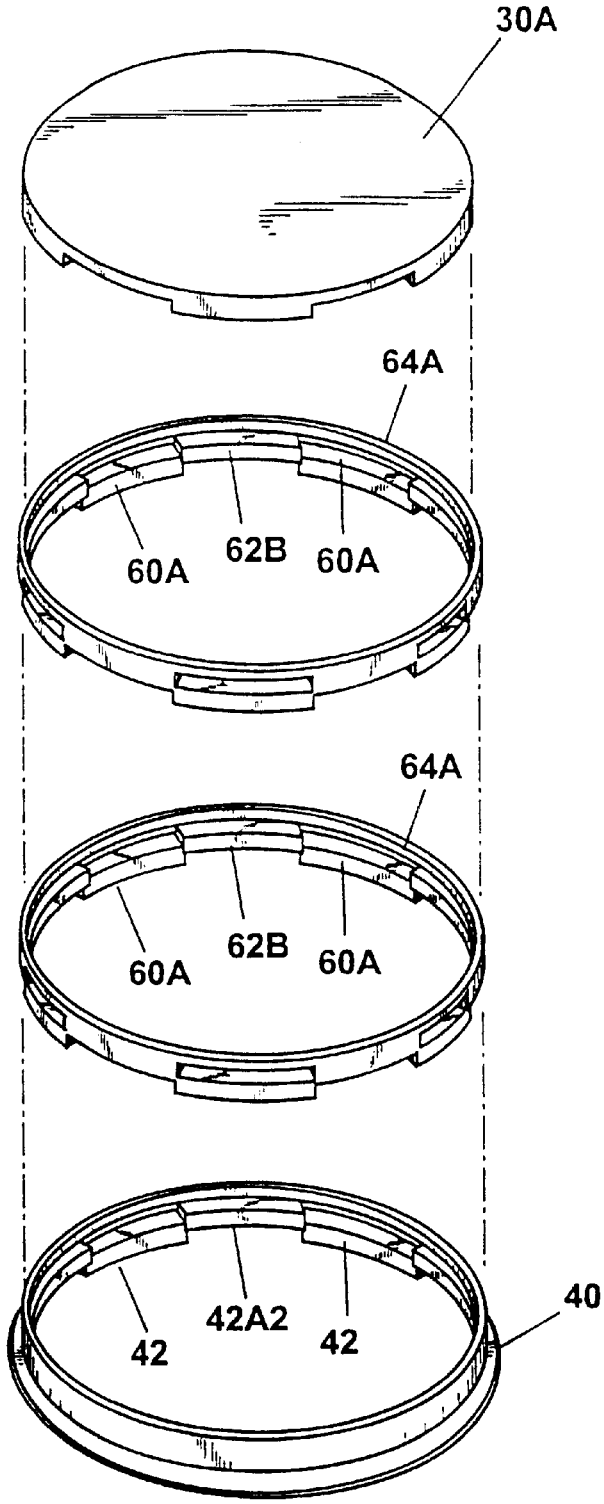
FIG. 5B is an exploded view of the assembly of FIGS. 5 and 6.

An overlay adapter 60B, depicted in FIGS. 7 and 8, is intended for installation in existing, conventional structures and affords many of the same advantages as those described above in connection with FIGS. 4A to 5B. The overlay adapter 60B is similar in structure to overlay adapter 60A in having a support 62B1 (FIG. 7) and a support 62B2 (FIG. 8) which correspond to supports 62A1 (FIG. 4A) and 62A2 (FIG. 4B), respectively, of overlay adapter 60A (FIGS. 4 to 4B). Overlay adapter 60B accommodates the conventional rim 40 by providing a thicker section under cover 30A at support 62B2. Overlay adapter 60B and cover 30A mate in the same manner as previously described in connection with FIGS. 4A and 4B.

Figure 9:
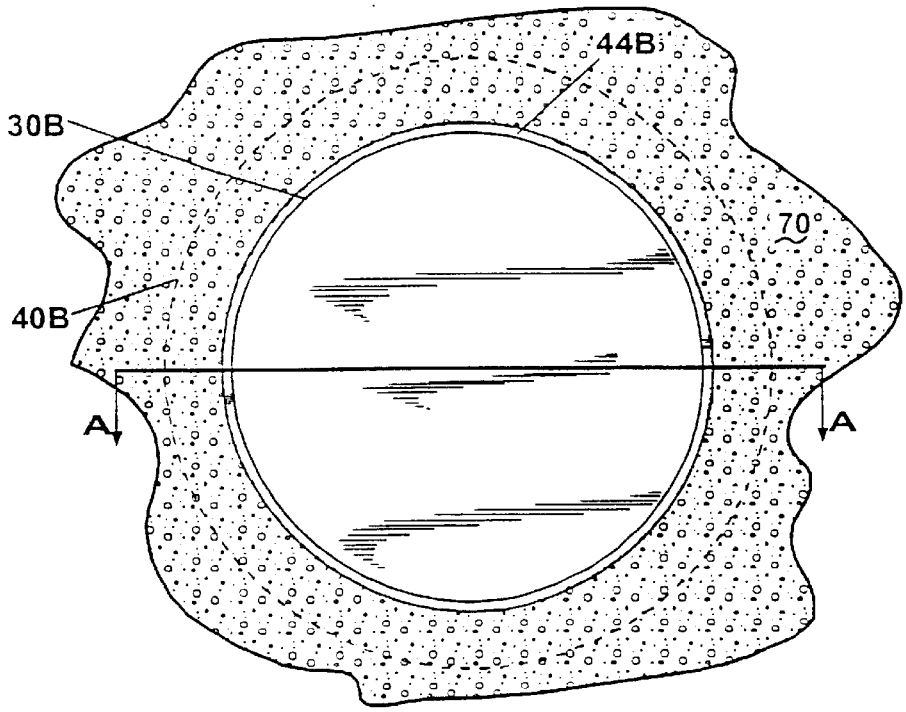
FIG. 9 is a plan view of an assembly including a manhole cover and a rim having a perimeter of constant radial section, the upper portion of the perimeter having reduced thickness.
Figure 9A:
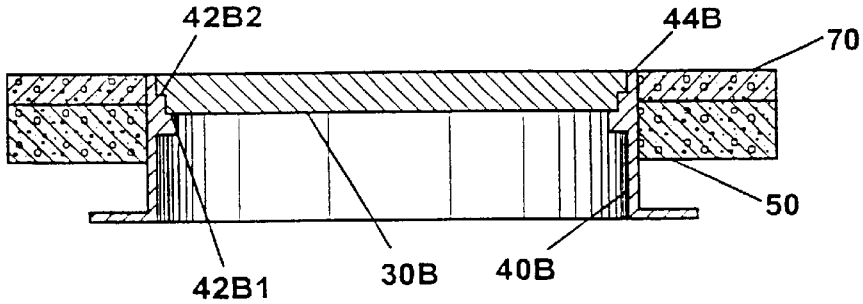
FIG. 9A is a sectional view taken along line A—A of FIG. 9.
Figure 10:
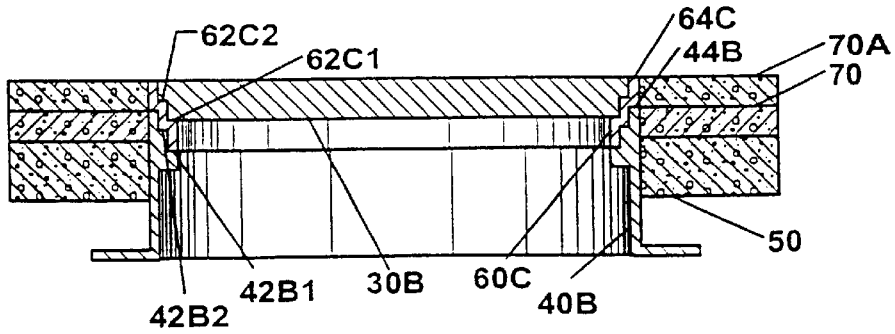
FIG. 10 is a view similar to FIG. 9A, but shows a third embodiment of an adapter according to the invention.
Figure 11:
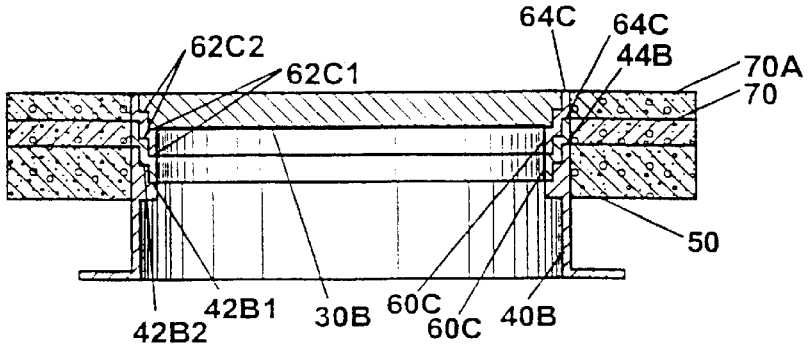
FIG. 11 is a view similar to FIG. 10, but shows an additional adapter conforming to the third embodiment thereof.

Alternative means for raising the elevation of a manhole structure in pavement by a minimal amount are illustrated in FIGS. 9, 9A and 10. A rim 40B is provided with a rim extension 44B which is flush with the surface of the adjacent wearing course, and the rim supports a cover 30B flush with the rim extension. The rim and cover differ from those disclosed in FIGS. 3 to 6, however, in that the cover is supported on an internal shoulder 42B1 and a raised step 42B2 which extend around the entire perimeter of the cover, as shown in FIG. 9A. FIG. 10 shows how the step provided between internal shoulder 42B1 and support 42B2 allows an overlay extension 64C to be structurally connected to a support 62C2, which is in turn structurally connected to a support 62C1. These structural connections ensure that an overlay adapter 60C can be used to raise the cover to the elevation of the overlay. The cylindrical members 64C, 62C2, and 62C1 making up the overlay adapter 60C allow the fabrication of the overlay adapter as a single piece which can be cast entirely of the same material as the cover and rim. FIG. 11 illustrates how a plurality of overlay adapters 60C can be stacked without reducing the clear opening of the structure.

Figure 12:
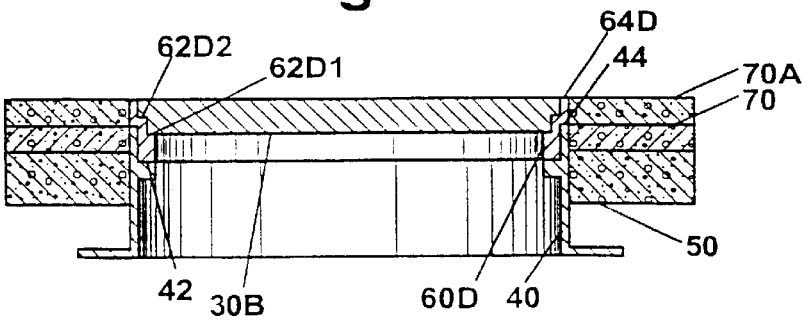
FIG. 12 is a sectional view, similar to FIG. 9A, of an assembly including a manhole cover having a perimeter of constant radial section, but shows a fourth embodiment of an adapter according to the invention within a prior-art manhole rim.

Returning for the moment to FIGS. 7 and 8, it will be clear how an existing, conventional rim 40 can be augmented minimally to accommodate the placement of an asphalt overlay by discarding the original cover 30 and installing a cover 30A on an overlay adapter 60B, both being constructed in accordance with the invention. FIG. 12 discloses similar means for raising the existing rim 40 minimally, by discarding the original cover and installing a new cover 30B, together with an overlay adapter 60D. Overlay adapter 60D is similar to overlay adapter 60C, with the exception that a support 62D2 is thicker, to fit snugly against interior shoulder 42 of the prior-art rim 40. A support 62D1 provides support under the bottom of the cover, as shown in FIG. 12. The cover 30B is supported at the same elevation as the adjacent overlay, and an overlay extension 64D effectively raises the rim elevation (between the cover and the overlay) to that of the overlay. The cylindrical members 64D, 62D2, and 62D1 making up the overlay adapter 60D allow the fabrication of the overlay adapter as a single piece which can be cast entirely of the same material as the cover and rim.

Figure 13:
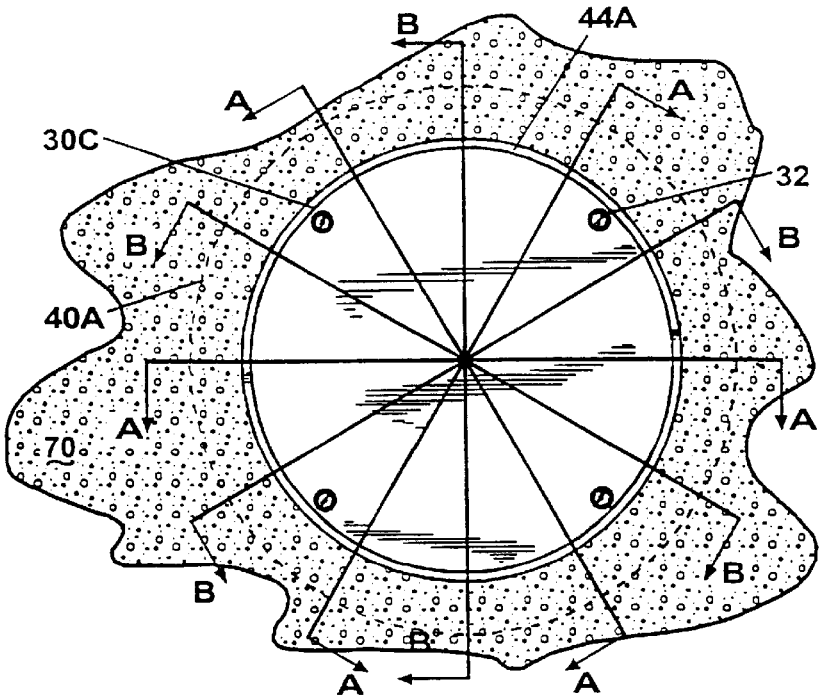
FIG. 13 is a plan view of an assembly including a manhole cover equipped with bolts to seal the cover to a rim.
Figure 13A:
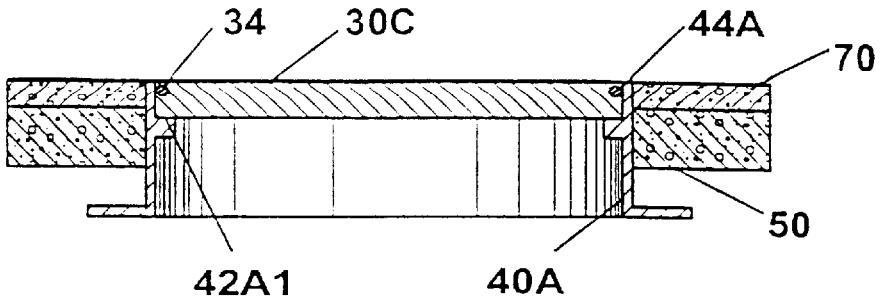
FIG. 13A is a sectional view taken along line A—A of FIG. 13.
Figure 13B:
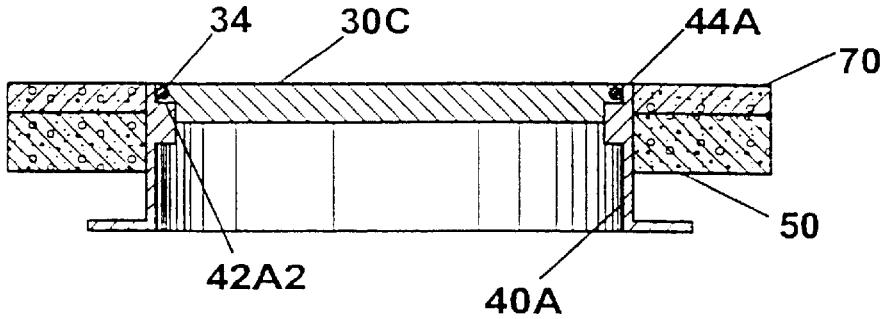
FIG. 13B is a sectional view taken along line B—B of FIG. 13.
Figure 14A:
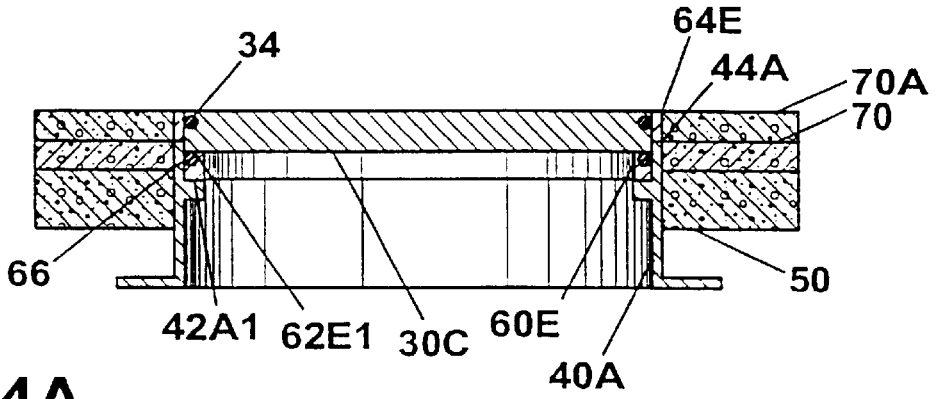
FIG. 14A is similar to FIG. 13A, but shows a fifth embodiment of an adapter according to the invention.
Figure 14B:
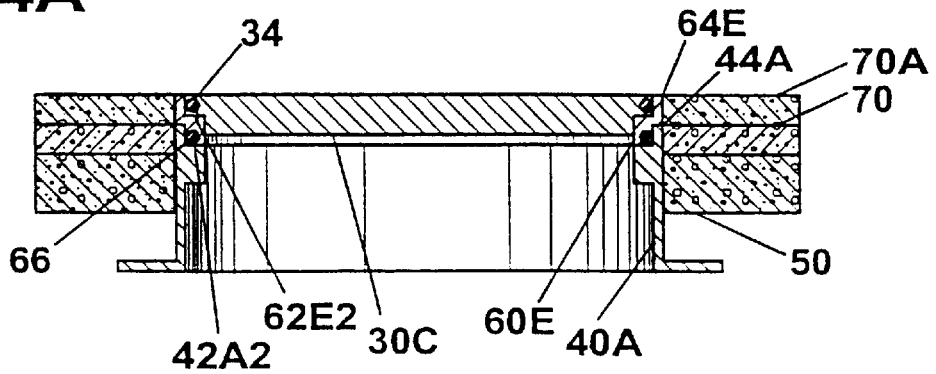
FIG. 14B is similar to FIG. 13B, but shows a fifth embodiment of an adapter according to the invention.

FIGS. 13 to 14B address the application of the invention to a manhole which is to be sealed against infiltration. A cover 30C is secured to rim 40A by one or more bolts 32, as shown in FIG. 13. FIG. 13A shows a location for an O-ring 34 around the perimeter of the cover. FIG. 13B shows the same O-ring, and indicates how the O-ring passes through that section of the rim having reduced thickness. FIG. 14A corresponds to FIG. 13A but shows an overlay adapter 60E in place. FIG. 14B corresponds to FIG. 14B and shows the same overlay adapter. The overlay adapter 60E is quite similar to that shown in FIGS. 4A and 4B, having an overlay extension 64E, a support 62E2, and a support 62E1, which together allow the fabrication of the overlay adapter as a single piece which can be cast entirely of the same material as the cover and rim. The overlay adapter has provision for an additional O-ring 66, however, which ensures that the overlay adapter 60E will be sealed to the rim 40A. The O-ring 34 in cover 30C ensures the cover is sealed to the adapter; together, cover 30C, overlay adapter 60E, and bolt(s) 32 seal the structure to prevent infiltration.

Figure 15:
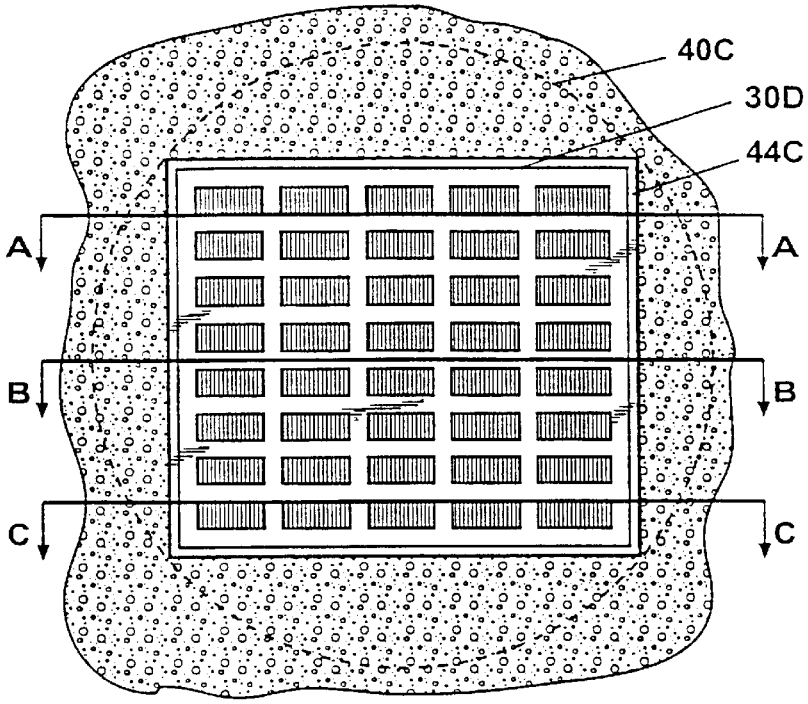
FIG. 15 is a plan view of an embodiment of a catch-basin rim and cover assembly according to the invention.

The invention can be used to allow the adjustment of a variety of shapes of structures within paved areas. The rectangular catch basin shown in FIG. 15 shows how the invention can be applied to a rim 40C which allows a rim extension 44C of the rim 40C to be installed flush with a concrete gutter 80 (FIGS. 15A and 15B), while allowing a cover 30D to be structurally supported at a level suitable to drain the leveling course of asphalt in new roads, parking lots, etc.

The rectangular cover 30D is typically made of cast iron, and is fabricated with a number of openings to admit liquid into the catch basin. The concrete gutter acts as a drainage channel in conveying liquid to the cover 30D. The rim 40C is also typically made of cast iron, and has an internal shoulder 42C1 (FIG. 15B) which provides structural support of the cover 30D. The internal shoulder 42C1 has a raised step 42C2 (FIGS. 15A and 15C) which mate with reduced sections of the cover 30D, in the same manner as previously described for crenellated rim 40A and cover 30A. The rim 40C also has a rim extension 44C along its uppermost edge, which rim extension is flush with the concrete gutter, as shown FIGS. 15A and 15B, and is flush with the leveling course of asphalt, as shown in FIG. 15C.

Figure 15A:
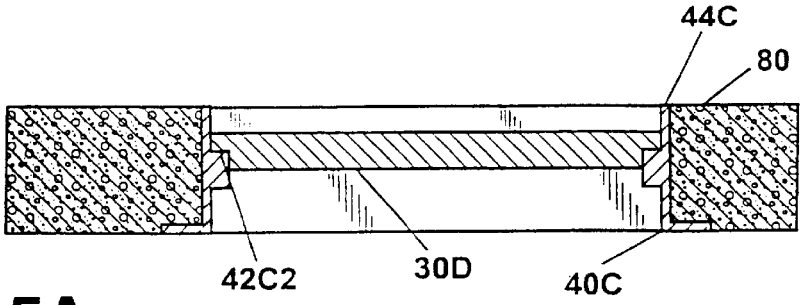
FIG. 15A is a sectional view taken along line A—A of FIG. 15, and also shows a partial curb and gutter section.
Figure 15B:
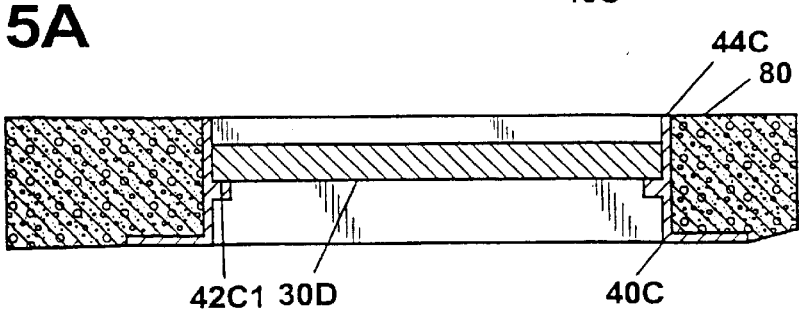
FIG. 15B is a sectional view taken along line B—B of FIG. 15, and also shows the curb and gutter section.
Figure 15C:
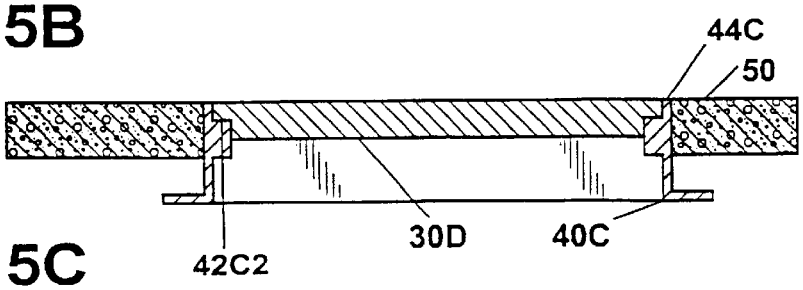
FIG. 15C is a sectional view taken along line C—C of FIG. 15, and also shows a partial section of asphalt pavement.
Figure 16:
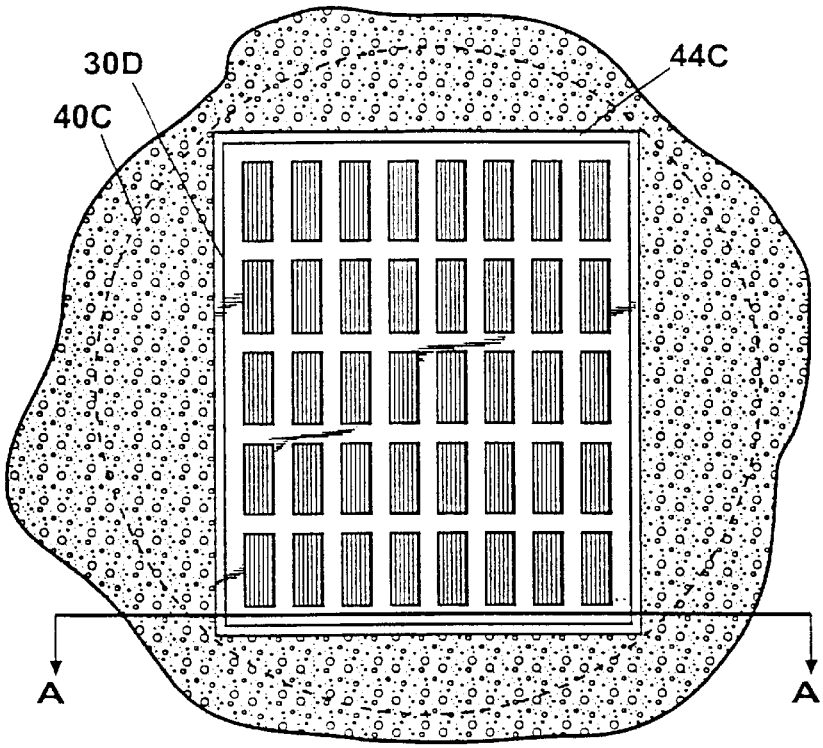
FIG. 16 is a plan view identical with FIG. 15, but rotated to show a section line at right angles to lines A—A, B—B, and C—C of FIG. 15.
Figure 16A:
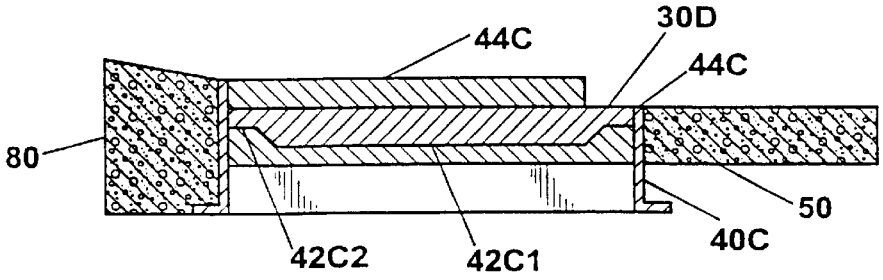
FIG. 16A is a sectional view taken along line A—A of FIG. 16.

FIG. 16A represents a section through rim 40C and cover 30D taken at right angles to the three sections represented in FIGS. 15A, 15B and 15C. FIG. 16A shows the rim extension 44C flush with the concrete gutter where the rim is installed in the concrete. The section further shows a step down in the rim extension 44C where the rim extends into the asphalt leveling course. The step in the rim extension 44C, together with the support of the cover 30D by the internal shoulder 42C1 at an elevation flush with that of the leveling course of asphalt, permits the asphalt to be drained readily into the cover 30D.

Figure 17:
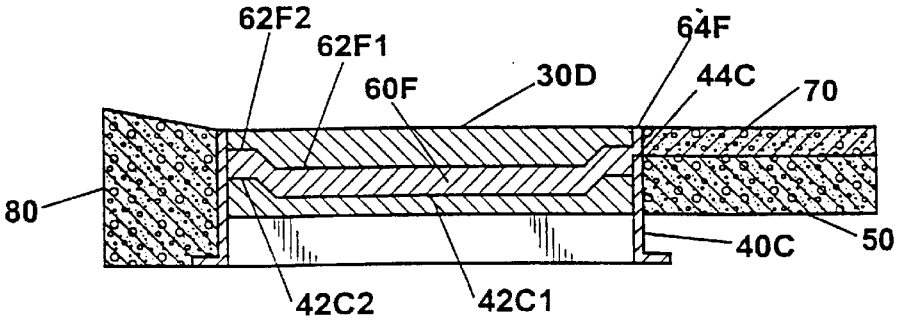
FIG. 17 is a view similar to FIG. 16A, but shows a sixth embodiment of an adapter according to the invention.

Many municipalities prefer not to install the upper layer of asphalt while heavy construction traffic is using the pavement. When construction is nearing completion, the wearing course of asphalt is placed. Referring to FIG. 17, a wearing course adapter 60F is shown placed between the rim 40C and the cover 30D. The wearing course adapter 60F is supported on internal shoulder 42C1 and raised step 42C2, and provides support for the cover 30D on a support 62F1 and a support 62F2, raising the cover to the elevation of the wearing course. The application of the inventive matter in raising covers of manholes, catch basins, etc. does not require that the support of the cover be contiguous around the perimeter of the cover. The wearing course adapter 60F shown provides support of three sides of the cover 30D; no support is provided along the rear side of the cover. A wearing course adapter extension 64F raises the elevation of the rim extension 44C to that of the wearing course. It will be noted that the presence of raised step 62F2 adjacent to the wearing course extension 64F allows an integral structural connection between the components of the wearing course adapter 60F, and further allows the wearing course adapter to be cast of a homogeneous material. It will be further noted that the placement of rim 40C, wearing course adapter 60F, and cover 30D may be advantageous even in areas which receive the wearing course of asphalt immediately, as removal of the wearing course adapter 60F will facilitate the milling of the wearing course, should the municipality or developer decide to remove and replace the wearing course. Similarly, installation of a wearing course adapter on manholes and other structures within the pavement will eliminate time and expense when the pavement is renovated by milling and replacing the wearing course.

Figure 18:
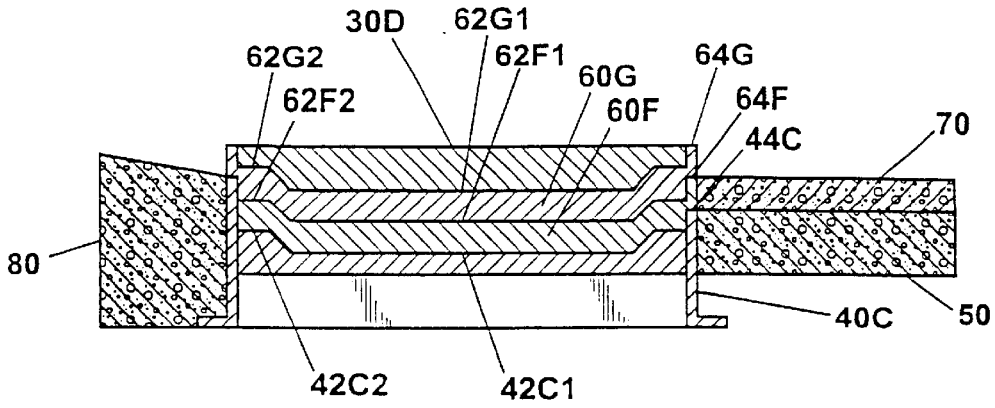
FIG. 18 is a view similar to FIG. 16A, but shows a seventh embodiment of an adapter according to the invention.

Over time, the pavement surface is typically repaired a number of times. It may become necessary to place an asphalt overlay over existing paving (concrete, asphalt, etc.) which is nearing the end of its serviceability. FIG. 18 shows the installation of an overlay adapter 60G which allows the cover 30D to be raised to an elevation flush with the proposed elevation of the overlay. The overlay adapter provides support for the cover on a support 62G1 and a support 62G2, raising the cover to the elevation of the overlay. The overlay adapter itself is supported by support 62F1 and 62F2 of the wearing course adapter 60F. The overlay adapter also provides an overlay extension 64G, which raises the elevation of the wearing course extension 64F to that of the proposed elevation of the overlay. It will be apparent that the presence of raised step 62G2 adjacent to the overlay extension 64G will allow an integral structural connection between the components of the overlay adapter 60G, and further allows the overlay adapter to be cast of a homogeneous material. The similarity of the respective mating surfaces (of the rim, the wearing course adapter, the overlay adapter, and the cover) for new manholes (FIGS. 3 to 6) and for new catch basins (FIGS. 15 to 18) will be apparent when each of the respective components are compared.

FIG. 19 shows a prior-art catch basin rim and cover, typical of many presently installed in paved areas throughout the country. An internal shoulder 42D integral to a rim 40D supports a cover 30E flush with the surface of the wearing course. A rim extension 44D similarly extends the elevation of the rim itself, and ensures it is flush with the wearing course. The arduous conventional process of cutting the old pavement from around the structure, raising the casting by inserting masonry and mortar under the casting, and pouring a concrete collar around the structure prior to the installation of the new pavement can be averted using the teachings above, although the old cover must be discarded to take advantage of the adapter according to the invention.

Figure 20:
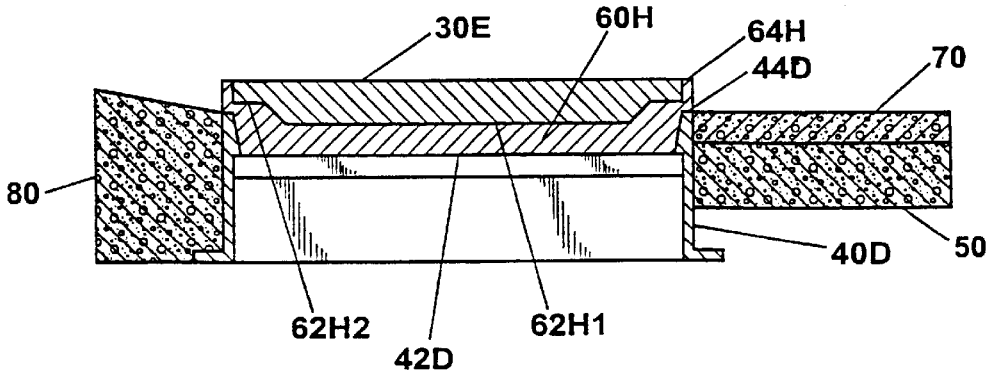
FIG. 20 is a view similar to FIG. 19, but shows an eighth embodiment of an adapter and a cover, both according to the invention assembled with the catch-basin rim of the prior art.

FIG. 20 shows the same conventional rim 40D, and illustrates placement of an overlay adapter 60H, which has been modified to accommodate the conventional rim. This modification consists of thickening a support 62H2 of the overlay adapter to provide structural support of cover 30E. The overlay adapter also provides a support 62H1, which supports the cover, and an overlay extension 64H, which raises the elevation of the rim extension 44D to that of the proposed elevation of the overlay. It will be noted that the presence of raised step 62H2 adjacent to the overlay extension allows an integral structural connection between the components of the overlay adapter, and further allows the overlay adapter to be cast of a homogeneous material. As indicated above, the old cover is not compatible with the support surface of the adapter and must be discarded. Neither the new cover nor the overlay adapter will diminish the clear opening of the structure, however, and will be reusable should additional adapters be placed to accommodate additional asphalt overlays.

Figure 21:
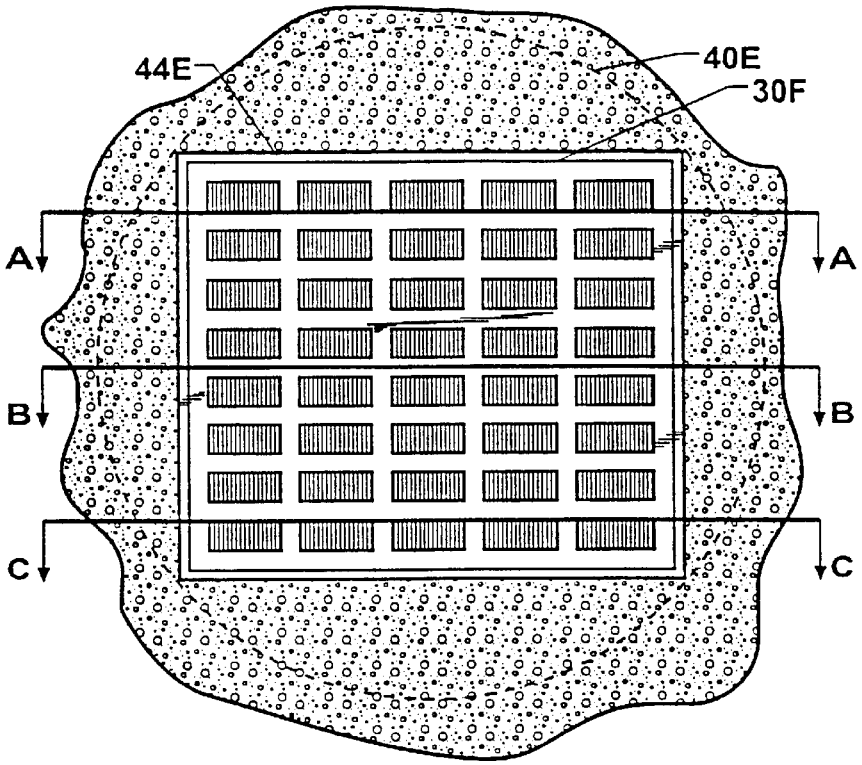
FIG. 21 is a plan view of a second catch basin rim and cover assembly according to the invention.
Figure 21A:
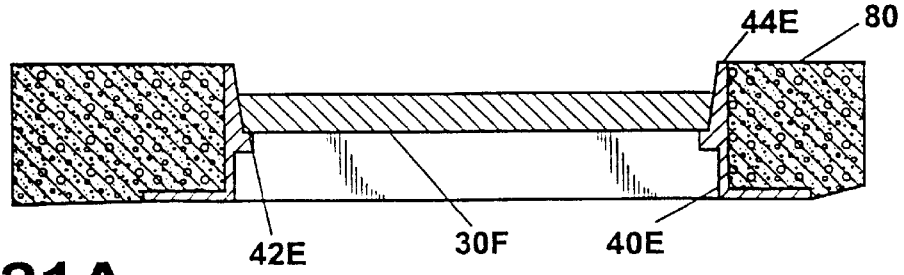
FIG. 21A is a sectional view taken along line A—A of FIG. 21, and also shows a partial curb and gutter section.
Figure 21B:
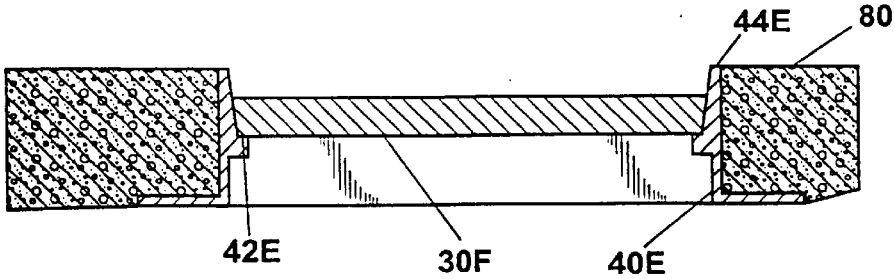
FIG. 21B is a sectional view taken along line B—B of FIG. 21, and also shows the partial curb and gutter section.
Figure 21C:
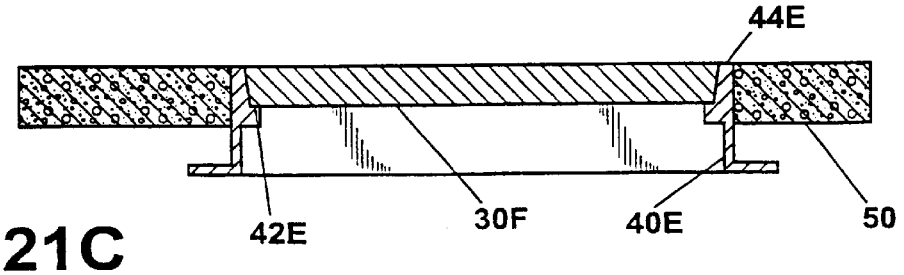
FIG. 21C is a sectional view taken along line C—C of FIG. 21, and also shows a section of asphalt pavement.
Figure 22:
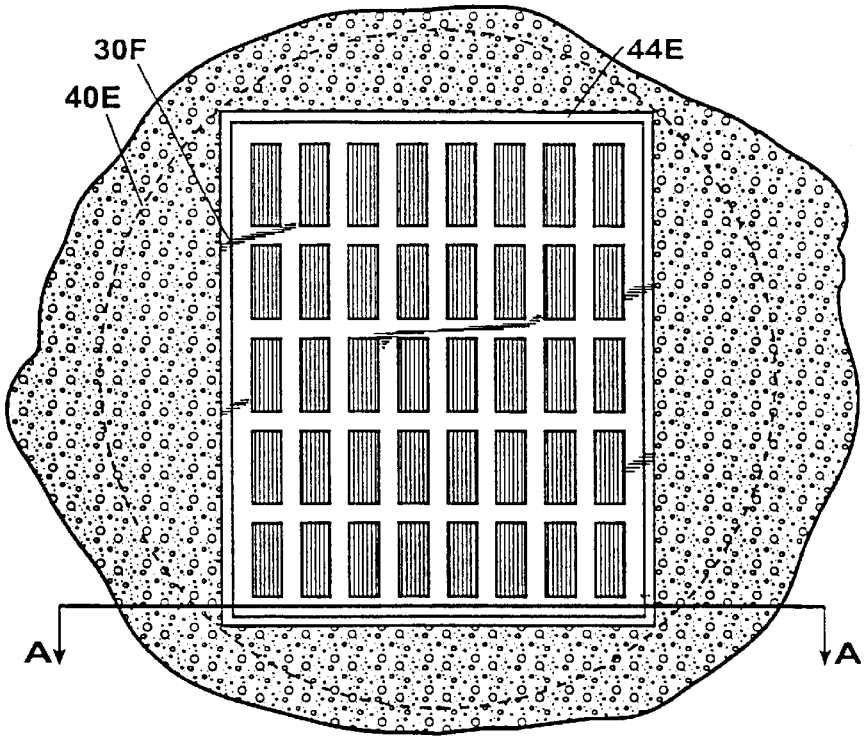
FIG. 22 is a plan view identical with FIG. 21, but rotated to show a section line at right angles to lines A—A, B—B, and C—C of FIG. 21.
Figure 22A:
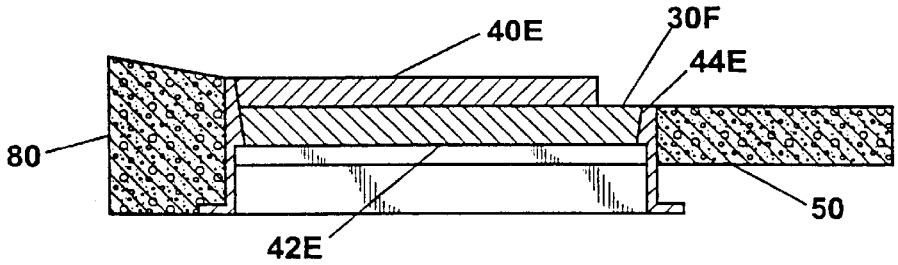
FIG. 22A is a sectional view taken along line A—A of FIG. 22.
Figure 23:
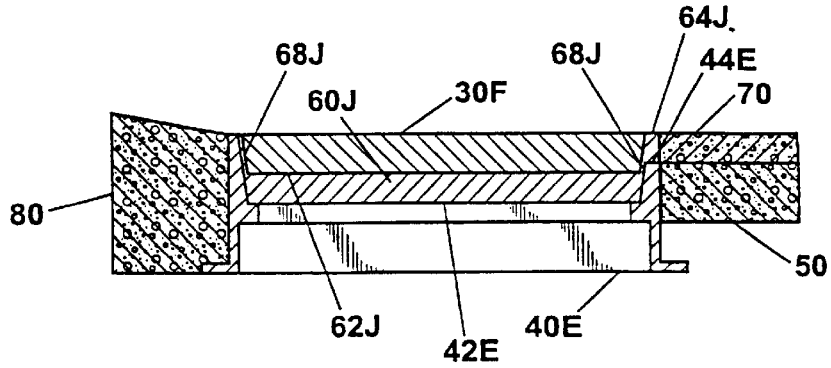
FIG. 23 is a view similar to FIG. 22A, but shows a ninth embodiment of an adapter according to the invention.

The method of draining the leveling course of asphalt which was discussed in relation to FIGS. 15 to 18 is also feasible if the municipality or developer mandates the use of steel segments in the wearing course adapters. FIG. 21 shows a rim 40E, a cover 30F, and a rim extension 44E which are similar to those disclosed in FIGS. 15A to 15C. The latter Figures show that cover 30D is supported on internal shoulder 42C1 and on raised step 42C2, while FIGS. 21A to 21C show cover 30F to be supported on an internal shoulder 42E, there being no raised step present. Comparison of the two sets of figures will also reveal that the mating surfaces of the cover and the rim in FIGS. 21A to 21C are slightly tapered. FIG. 23 shows how this slight taper allows the use of one or more steel connectors 68J in wearing course adapter 60J, between a wearing course extension 64J and a support 62J. The presence of a step in rim extension 44E permits the use of a variant of the prior-art overlay adapters as disclosed in FIG. 23, permitting their use as wearing course adapters.

Figure 24:
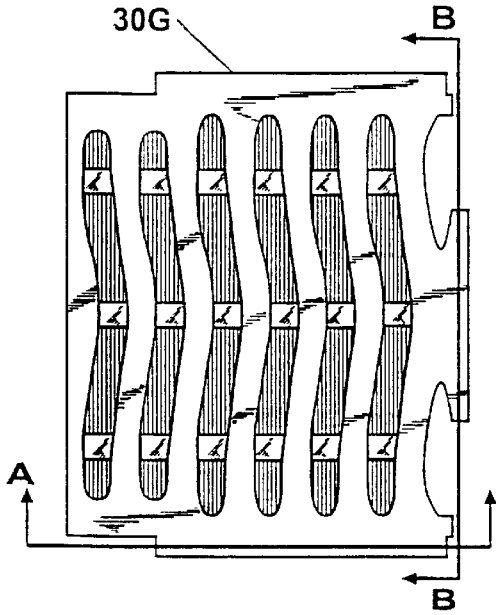
FIG. 24 is a plan view of a third and preferred embodiment of a catch-basin cover according to the invention.
Figure 25:
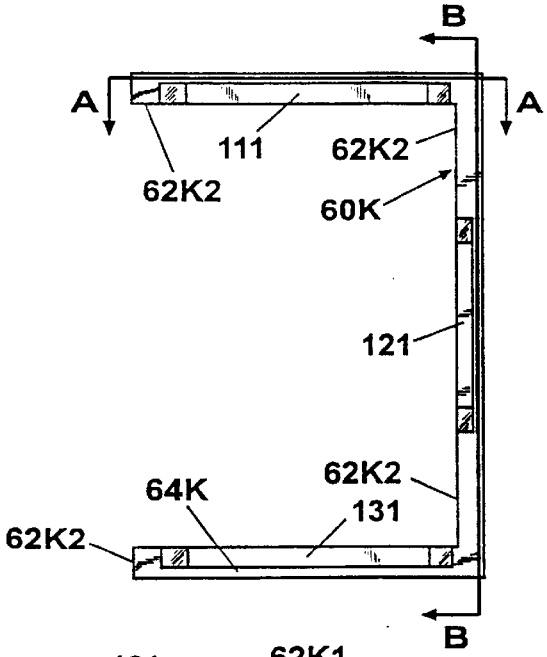
FIG. 25 is a plan view of a tenth and preferred embodiment of an adapter according to the invention.
Figure 25B:
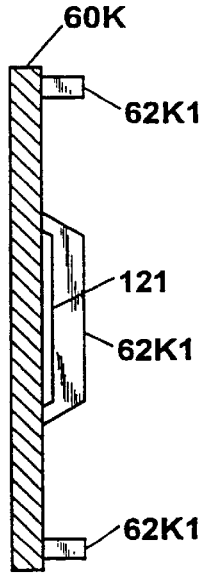
FIG. 25B is an elevational view taken along line B—B of FIG. 25.
Figure 25A:
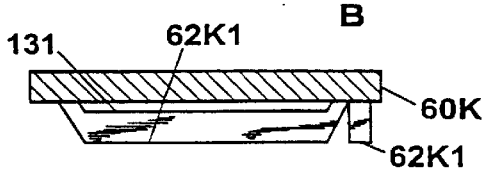
FIG. 25A is an elevational view taken along line A—A of FIG. 25.
Figure 26:
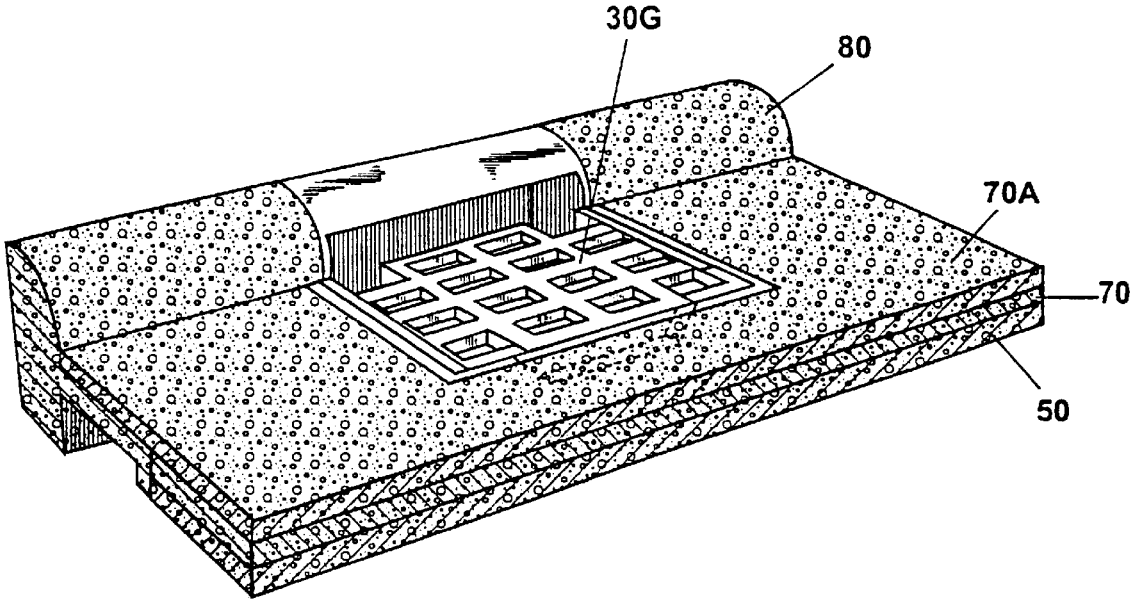
FIG. 26 is a perspective view of a catch-basin assembly according to the invention installed in a curb and gutter.
Figure 27:
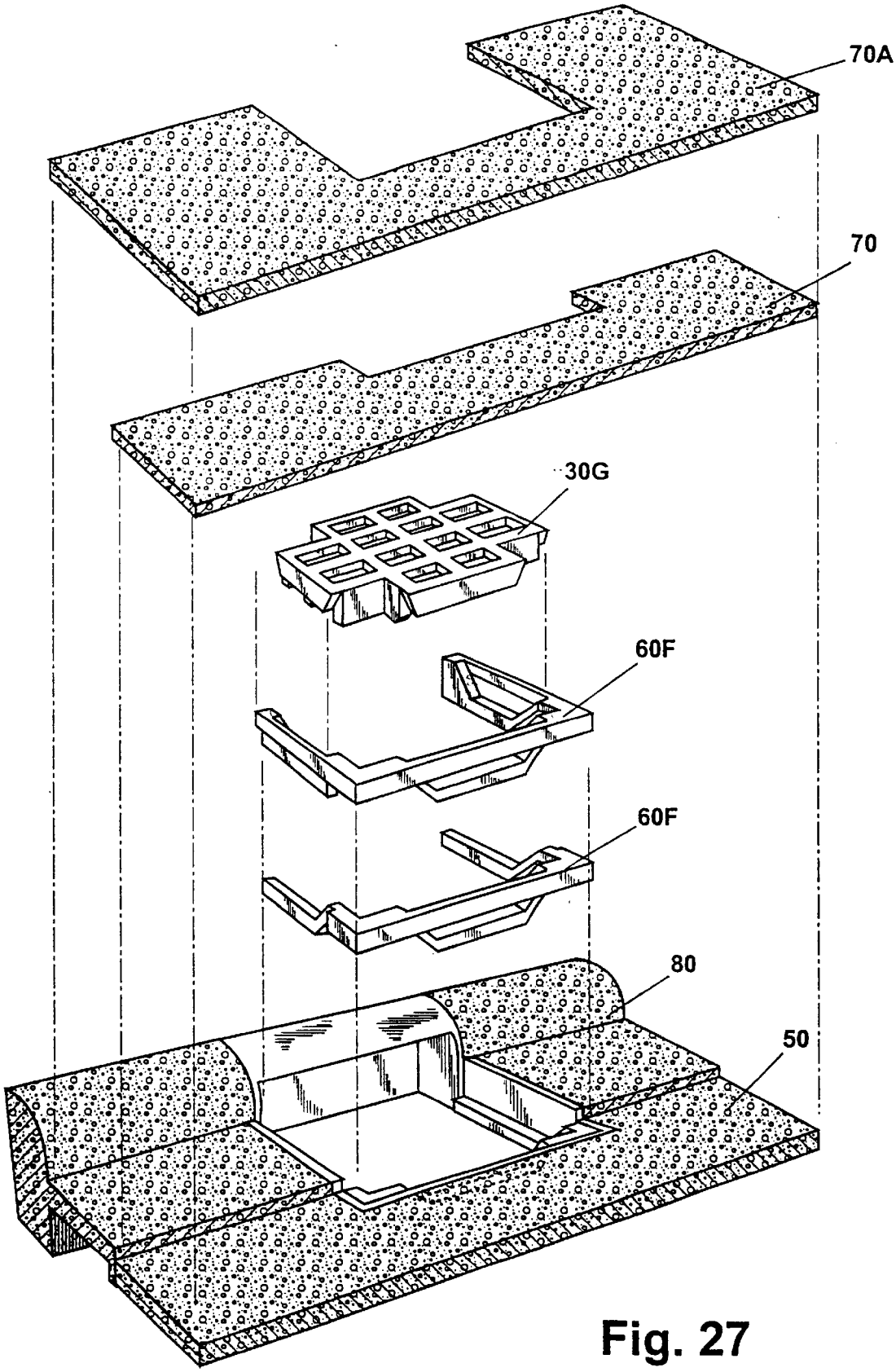
FIG. 27 is an exploded view of the assembly of FIG. 26.
Figure 28:
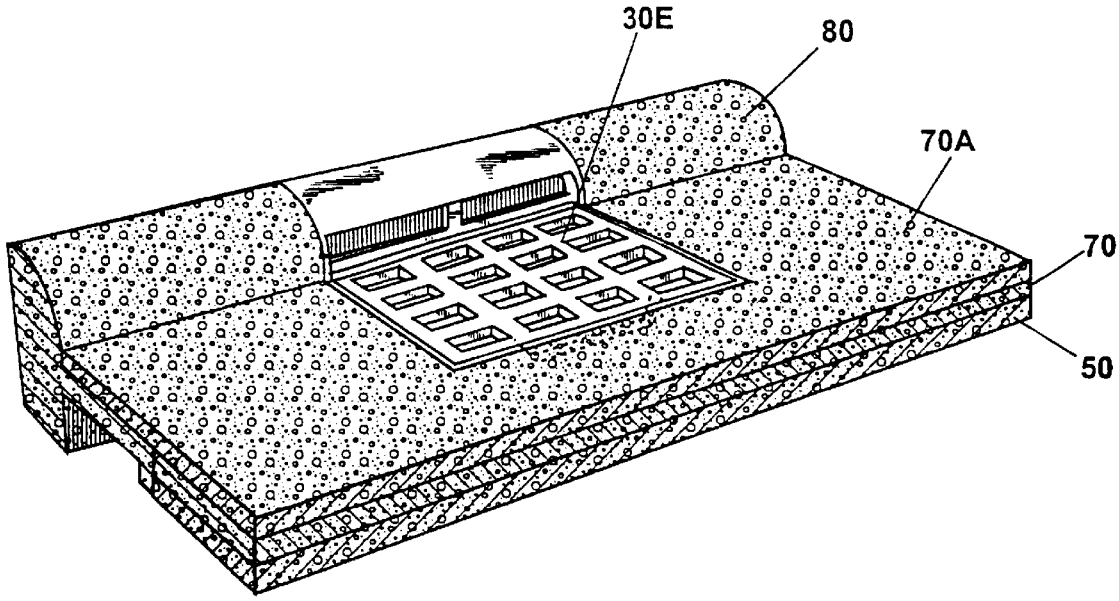
FIG. 28 is a perspective view of a catch-basin assembly including a prior-art catch-basin rim and installed in a curb and gutter.
Figure 29:
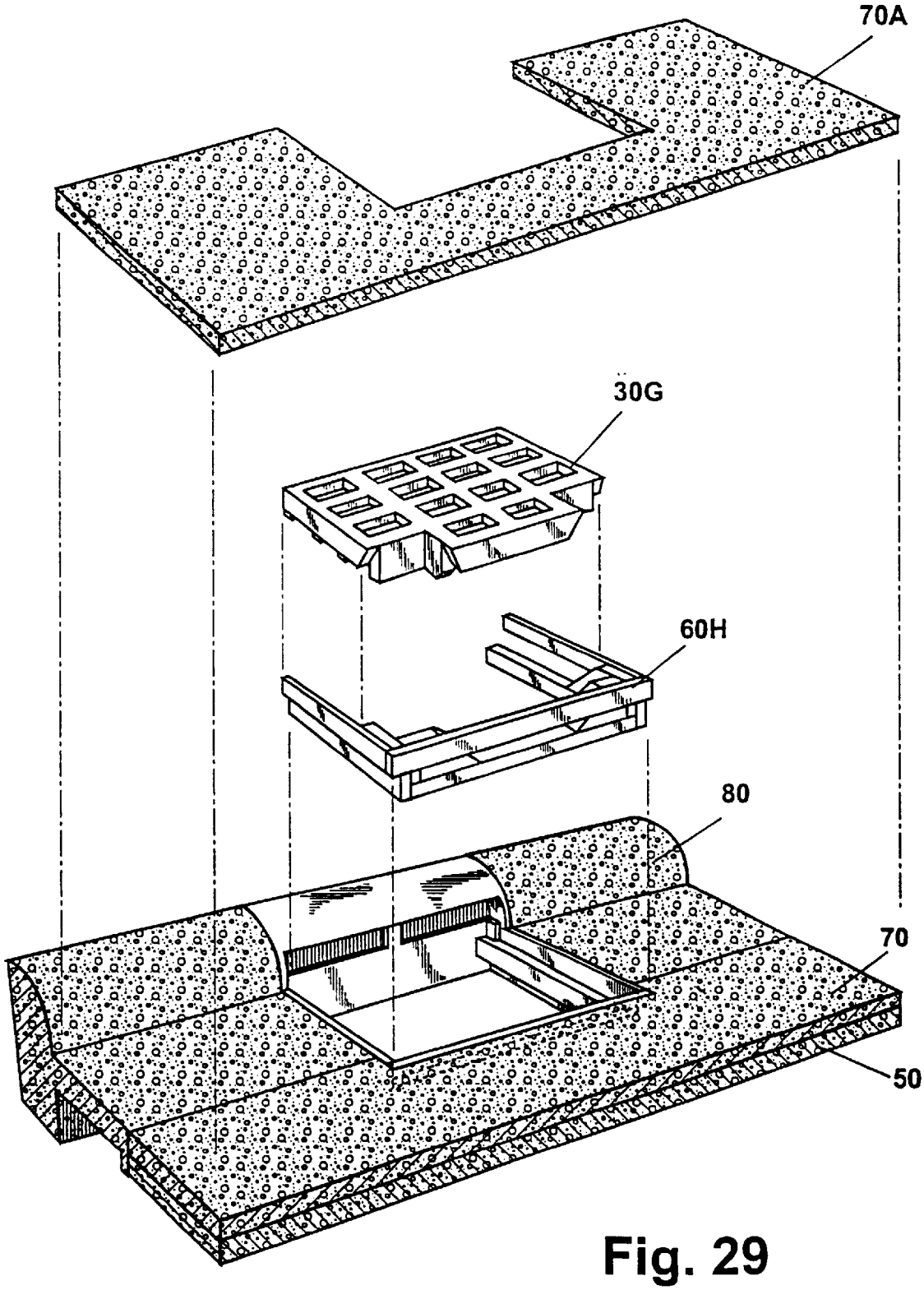
FIG. 29 is an exploded view of the assembly of FIG. 28.

An embodiment of the invention perhaps preferred above the others previously described is shown in FIGS. 24 to 25B. The previously described embodiments have more than one bearing surface (for example, internal shoulder 42A1 and raised step 42A2 shown in FIGS. 3A and 3B), and the cover may be prone to rocking as the casting wears. This rocking is due to differing degrees of support offered by the various bearing surfaces.

Figure 24B:
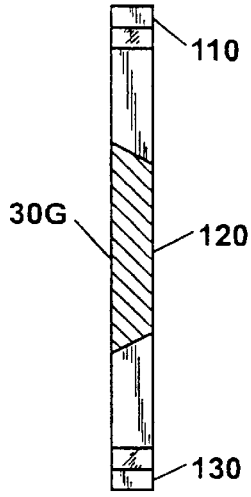
FIG. 24B is an elevational view taken along line B—B of FIG. 24.
Figure 24A:
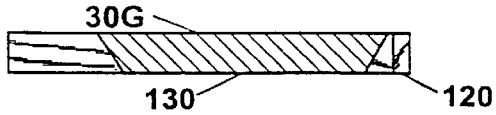
FIG. 24A is an elevational view taken along line A—A of FIG. 24.

A cover 30G shown in FIG. 24 is intended to prevent any such rocking. The cover is modeled after cover 7045 M1 available from East Jordan Iron Works, Inc., but the front and rear corners of the cover have been removed. FIG. 24A shows a load bearing surface 130 along the side of the cover and a load bearing surface 120 at the front of the cover. FIG. 24B is a view of the front edge of the cover, and shows load bearing In conclusion, it will be understood that the use of the structures according to the invention disclosed herein will permit the rapid adjustment of the elevation of various types of structures within paved areas. The speed with which the adjustments can be made will reduce the danger to highway workers and motorists, decrease the amount of time sections of roads will be closed or congested, and reduce the budgetary requirements necessary for either initial road paving or road restoration.

While the invention has been specifically described in connection with certain specific embodiments thereof, it is to be understood that this is by way of illustration and not of limitation, and the scope of the appended claims should be construed as broadly as the prior art will permit.

What is claimed is:

1. An assembly for adjusting the elevation of a structure, comprising a base rim, the base rim comprising an outer wall and a support shoulder positioned on an inside of the wall at a height below a top of the rim and extending towards the center of the base rim, the support shoulder having at least one protrusion;

a cover configured to fit with the base rim and in contact with the support shoulder, the cover having at least one indentation which fits with the protrusion of the support shoulder in combination with an adapter comprising a lower member positionable within the wall of the base rim and in contact with the support shoulder; and an upper member extending outward from the lower member to receive the cover and extending upwardly from the top of the base rim, the adapter having at least one adapter protrusion which connects the upper and lower members, the adapter protrusion configured to fit with the support shoulder protrusion and the cover indentation, whereby the elevation of a structure may be increased by inserting the adapter between the base rim and the cover and decreased by removing the adapter from between the base rim shoulder and the cover.

2. The assembly of claim 1 combination with a second adapter configured to fit with the first adapter by contact of the lower member of the first adapter with a lower member of the second adapter, and the cover in contact with the lower member of the second adapter and within an upper member of the second adapter.

3. The assembly of claim 2 wherein the second adapter is configured to receive the at least one protrusion of the first adapter.

4. The assembly of claim 1 wherein the adapter is secured to the base rim using bolts or setscrews.

5. The assembly of claim 1 wherein the structure is a manhole, and the base rim, the adapter, and the cover are of generally circular shape.

6. The assembly of claim 1 wherein the structure is a catch-basin, and the base rim, the adapter, and the cover are of generally rectangular shape.

7. An assembly for adjusting the elevation of a structure to be surrounded by pavement, comprising a base rim having an outer wall and a support shoulder extending inwardly from the wall and spaced from an upper end thereof, a cover, and an adapter formed in a single piece to support the cover thereon, the adapter having upper and lower members, the lower member being receivable within the outer wall of the base rim to be supported on the shoulder thereof, the upper member extending laterally outward from the lower member and upwardly to overlie a top edge of the base rim and form an upward extension of the outer wall of the base rim, interconnections between the upper and lower members, the base rim shoulder being formed with at least one upwardly extending protrusion which fits between the interconnections of the adapter, the cover being receivable within the upper member of the adapter to be supported on the lower member of the adapter, the cover being formed with at least one indentation in a lower surface thereof which fits with the interconnections of the adapter, whereby the elevation of a structure may be increased by inserting the adapter between the base rim and the cover and decreased by removing the adapter from between the base rim and the cover wherein a vertical extent of the adapter raises the elevation of the structure a distance less than a thickness of the cover when the adapter is inserted between the base rim and the cover.

8. The assembly of claim 7 in combination with a second adapter configured to fit with the first adapter and contact the lower member of the first adapter, the second adapter configured to receive the cover.

9. The assembly of claim 7 wherein the base rim, adapter and cover are generally circular.

10. The assembly of claim 7 wherein the base rim, adapter and cover are generally rectangular.

11. The assembly of claim 7 wherein the cover has openings proximate to the indentations.

12. An assembly for adjusting the elevation of a catch-basin structure for incorporation into a road construction, the assembly comprising:

a generally rectangular base rim comprising a generally rectangular outer wall and a support shoulder on an inside of the outer wall spaced from a top edge of the outer wall and extending laterally inward from the outer wall;

a generally rectangular adapter configured to fit with the base rim and to receive and support a cover at an elevation above the top edge of the outer wall of the base rim, the adapter comprising a lower member positionable within the outer wall of the base rim and on the support shoulder, and an upper member extending laterally outward from the lower member and over the top edge of the outer wall of the base rim and extending upwardly above the top edge of the outer wall of the base rim to form an upward extension of the outer wall of the base rim, at least one adapter protrusion which connects the upper and lower members, and the cover having at least one indentation dimensioned to fit with the adapter protrusion.

13. The assembly of claim 12 wherein the upper member of the adapter has a vertical dimension less than a thickness of the cover, and the cover extends from the lower member to the upper member of the adapter.

14. The assembly of claim 12 further comprising a second adapter configured to fit with the first adapter and to contact the lower member of the first adapter, the second adapter having lower and upper members connected by at least one adapter protrusion, the lower member of the second adapter in contact with the lower member of the first adapter, and the adapter protrusion of the second adapter located proximate to the adapter protrusion of the first adapter.

15. An assembly for adjusting the elevation of a catch basin structure having a base rim surrounded by pavement, the base rim comprising a generally rectangular outer wall and a support shoulder extending inwardly from the outer wall and spaced from a top edge of the outer wall, the assembly comprising a generally rectangular catch basin cover, an adapter formed in a single piece to support the catch basin cover thereon, the adapter having upper and lower members, the lower member being receivable within the outer wall of the base rim to be supported by the support shoulder, the upper member extending laterally outward from the lower member, and extending upwardly relative to the top edge of the outer wall to form an upward extension of the outer wall, interconnections between the lower and upper members of the adapter, the catch basin cover having indentations which fit around the interconnections between the lower and upper members of the adapter, whereby the elevation of the catch basin structure may be increased by installation of the adapter between the base rim and the catch basin cover.

16. The assembly of claim 15 wherein the indentations in the catch basin cover are located at corners of the catch basin cover.

17. The assembly of claim 15 in combination with a second adapter configured to fit with the first adapter and to receive the cover, the second adapter having lower and upper members with interconnections therebetween, the lower member of the second adapter configured to contact the lower member of the first adapter, and the upper member of the second adapter configured to surround at least a portion of the cover.

18. An adjustable catch basin assembly comprising:

a base rim having a generally rectangular outer wall and a support shoulder which extends inwardly from the outer wall and spaced from a top edge of the outer wall, the support shoulder having at least one raised step;

a cover dimensioned to fit within the base rim and contact the support shoulder, the cover having at least one indentation which fits with the at least one raised step of the support shoulder, and an adapter having upper and lower members, and at least one structural connection between the upper and lower members, the lower member being receivable within the outer wall for contact with the support shoulder of the outer wall, the upper member located laterally outward from the lower member for contact with the top edge of the outer wall, the indentation in the cover fitting with the at least one structural connection between the upper and lower members.

19. The assembly of claim 18, comprising four structural connections between the upper and lower members of the adapter, and four corresponding indentations in the cover.

20. The assembly of claim 18 in combination with a second adapter having upper and lower members and at least one structural connection between the upper and lower members, the second adapter configured to fit between the first adapter and the cover, the upper member of the second adapter located over the upper member of the first adapter, the at least one structural connection between the upper and lower members of the first adapter being proximate to the at least one structural connection between the upper and lower members of the second adapter.

21. A height-adjustable manhole assembly, comprising:

a generally circular base rim surrounded by pavement, the base rim comprising a generally circular outer wall and an annular support shoulder on an inside of the outer wall and extending toward a center of the base rim, the support shoulder having at least one raised step;

and a cover having at least one indentation which fits with the raised step in the support shoulder of the base rim, and a generally circular adapter which fits with the base rim and supports the cover, the adapter comprising a lower member positionable within the outer wall of the base rim and supported by the support shoulder, and an upper member extending laterally outward from the lower member and extending upwardly from the top edge of the outer wall to form an upward extension of the outer wall, wherein the lower member includes at least one structural connection which extends upwardly to connect the upper and lower members, the at least one indentation in the cover fitting with the at least one structural connection of the adapter.

* * * * *